US008002380B2

(12) United States Patent
Kondo

(10) Patent No.: US 8,002,380 B2
(45) Date of Patent: Aug. 23, 2011

(54) CARTRIDGE-INFORMATION DETECTING DEVICE

(75) Inventor: Hirofumi Kondo, Tajimi (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 440 days.

(21) Appl. No.: 12/338,383

(22) Filed: Dec. 18, 2008

(65) Prior Publication Data

US 2009/0167809 A1 Jul. 2, 2009

(30) Foreign Application Priority Data

Dec. 28, 2007 (JP) ..... 2007-340597

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 5,754,195 A 5/1998 Yokono
7,416,290 B2 8/2008 Hattori et al.

*Primary Examiner* — Julian D Huffman
(74) *Attorney, Agent, or Firm* — Frommer Lawrence & Haug LLP

(57) ABSTRACT

A cartridge-information detecting device including: an optical sensor for detecting information about a cartridge which stores ink and is removably mounted on a cartridge mount, the information including specific information indicating that the cartridge is in a state of being mounted on or removed from the cartridge mount; and a controller including a timer which measures time and configured to execute a control for changing an operational mode of the optical sensor, wherein the controller permits the optical sensor to operate in a constant operational mode in which the information about the cartridge is constantly detected through the optical sensor until the timer has measured a predetermined time from a timing at which the detection of information about the cartridge becomes to be allowed, and wherein the controller permits the optical sensor to operate in an intermittent operational mode in which only the specific information is intermittently detected through the optical sensor, after the predetermined time has passed.

12 Claims, 28 Drawing Sheets

CARTRIDGE-INFORMATION DETECTING DEVICE

CROSS REFERENCE TO RELATED APPLICATION

The present application claims priority from Japanese Patent Application No. 2007-340597, which was filed on Dec. 28, 2007, the disclosure of which is herein incorporated by reference in its entirety.

BACKGROUND OF THE INVENTION

1. Field of the Invention

The present invention relates to a cartridge-information detecting device configured to detect information including specific information indicating that a cartridge is in a state of being mounted on or removed from a cartridge mount when the cartridge is mounted on the cartridge mount.

2. Description of the Related Art

Conventionally, there is widely known an ink-jet image recording apparatus configured to record an image on a recording sheet by ejecting ink from a recording head. A cartridge storing the ink can be mounted on the image recording apparatus, and the ink supplied from the cartridge is ejected from the recording head. Where a remaining amount of the ink in the cartridge becomes relatively small, the cartridge is removed, and a new cartridge filled with the ink is mounted on the image recording apparatus, whereby image recording can be continued to be performed.

There are some ink-jet image recording apparatuses each including an optical sensor for detecting a remaining amount of ink in a cartridge which is in a state of being mounted in the image recording apparatus.

SUMMARY OF THE INVENTION

Generally in the optical sensor, a light-emitting diode and a photo diode are used respectively as a light-emitting element and a light-receiving element. In particular, the light-emitting diode is deteriorated with operating time thereof, so that brightness thereof during the operation is lowered. In detecting the remaining amount of the ink, where, after a user has removed the cartridge having a relatively small remaining amount of the ink from the image recording apparatus, a cartridge cover is left opened without mounting a new cartridge, for example, the optical sensor, which is started to operate upon opening of the cartridge cover, continues to operate, so that the optical sensor is deteriorated faster.

This invention has been developed in view of the above-described situations, and it is an object of the present invention to provide a cartridge-information detecting device which can restrain deterioration of an optical sensor for detecting information about a cartridge.

The object indicated above may be achieved according to the present invention which provides a cartridge-information detecting device comprising: an optical sensor for detecting information about a cartridge which stores ink and is removably mounted on a cartridge mount, the information including specific information indicating that the cartridge is in a state of being mounted on or removed from the cartridge mount; and a controller including a timer which measures time and configured to execute a control for changing an operational mode of the optical sensor, wherein the controller permits the optical sensor to operate in a constant operational mode in which the information about the cartridge is constantly detected through the optical sensor until the timer has measured a predetermined time from a timing at which the detection of information about the cartridge becomes to be allowed, and wherein the controller permits the optical sensor to operate in an intermittent operational mode in which only the specific information is intermittently detected through the optical sensor, after the predetermined time has passed.

It is noted that, in the constant operational mode, the optical sensor is in a constant active state in which the information about the cartridge is constantly detected through the optical sensor. On the other hand, in the intermittent operational mode, the optical sensor is in an intermittent active state in which only the specific information is intermittently detected through the optical sensor.

In the cartridge-information detecting device constructed as described above, since the controller permits the operational sensor to operate in the intermittent operational mode after the predetermined time has passed, deterioration of the optical sensor caused by operating thereof for a relatively long time can be prevented. Further, since the controller permits the operational sensor to operate in the constant operational mode during the predetermined time, where the cartridge is mounted on the cartridge mount in this predetermined time, the information about the cartridge can be properly detected.

BRIEF DESCRIPTION OF THE DRAWINGS

The objects, features, advantages, and technical and industrial significance of the present invention will be better understood by reading the following detailed description of a preferred embodiment of the invention, when considered in connection with the accompanying drawings, in which.

DESCRIPTION OF THE PREFERRED EMBODIMENT

Hereinafter, there will be described a cartridge-information detecting device as a preferred embodiment of the present invention by reference to the drawings, taking an ink-jet image recording apparatus (hereinafter, the image recording apparatus) including the cartridge-information detecting device, as an example. It is to be understood that the following embodiments are described only by way of example, and the invention may be otherwise embodied with various modifications without departing from the scope and spirit of the invention.

Outline of Entirety of Image Recording Apparatus

Figure 1:
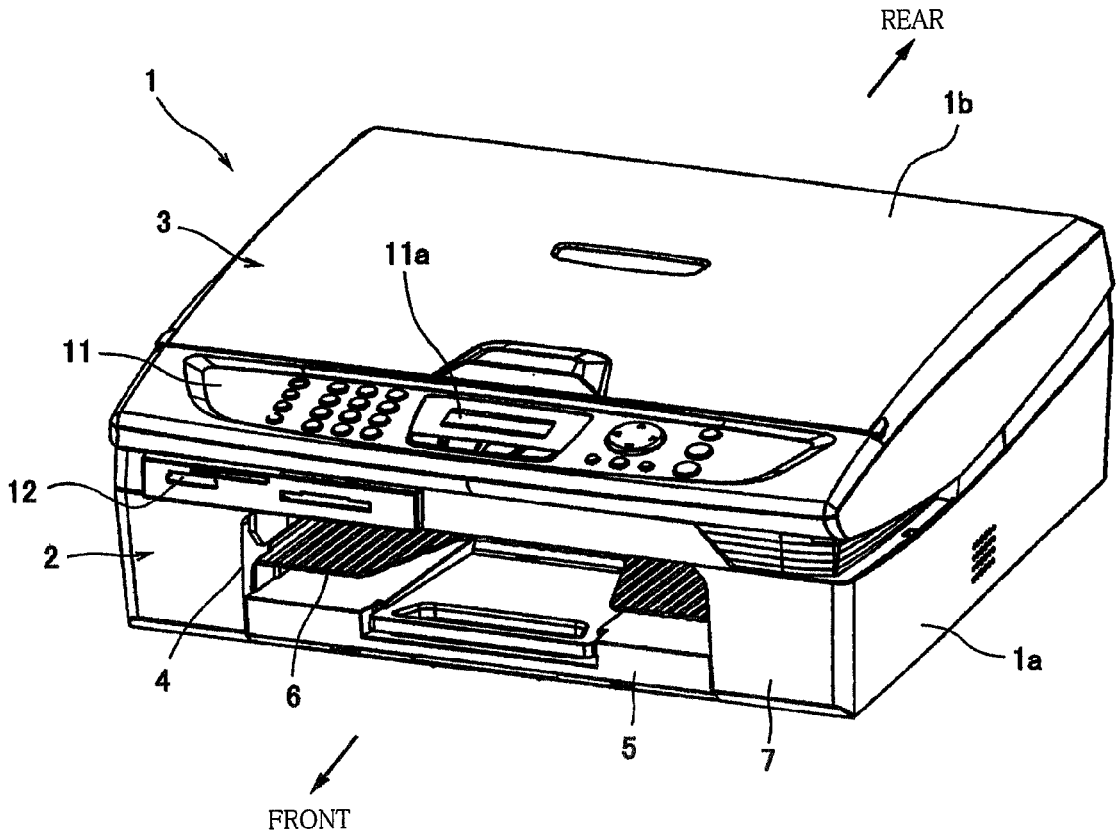
FIG. 1 is a perspective view showing an external construction of an image recording apparatus to which the present invention is applied.

FIG. 1 shows what is called a multi-function apparatus having a printing function, a scanning function, a copying function, and a facsimile function as an image recording apparatus 1 to which the present invention is applied. As shown in FIG. 1, the image recording apparatus 1 includes, at a lower portion thereof, a casing 1*a* having a generally rectangular parallelepiped shape. Further, the image recording apparatus 1 includes, at a lower portion of the casing 1*a*, a printing section 2 of an ink-jet type which records an image on a recording sheet as a recording medium, and, at an upper portion of the casing 1*a*, a scanning section 3.

The printing section 2 of the image recording apparatus 1 has an opening 4 in a front face of the casing 1*a*. In the opening 4, a sheet-supply tray 5 and a sheet-discharge tray 6 are arranged such that the sheet-discharge tray 6 is superposed on the sheet-supply tray 5. The sheet-supply tray 5 can accommodate a plurality of the recording sheets. For example, the sheet-supply tray can accommodate a plurality of recording sheets of various sizes equal to or smaller than A4 size.

A cover 7 is provided on a right lower portion of the front face of the printing section 2 so as to be openable and closable. In a portion of the image recording apparatus 1 which is covered with the cover 7, a cartridge mount 8 (shown in FIG. 2) is provided. Thus, when the cover 7 is opened, the cartridge mount 8 is exposed to the front, so that cartridges 10 (shown in FIG. 2) can be mounted or removed in a horizontal direction. The cartridge mount 8 is provided with an accommodating casing 9 (shown in FIG. 2) on which the cartridges 10 are mounted and which corresponds to respective ink colors of the cartridges 10. In this printing section 2, five color inks are used, for example. That is, cyan (C), magenta (M), yellow (Y), photo black (PBk) dye inks, and a black (Bk) pigment ink are used. Thus, the cartridge mount 8 is provided with the accommodating casing 9 whose inner space is separated into five spaces. The cartridges 10 respectively storing the cyan, magenta, yellow, photo black, and black inks are mounted in the respective five spaces.

The scanning section 3 provided in the upper portion of the image recording apparatus 1 is constituted by what is called a flatbed scanner. That is, as shown in FIG. 1, on an upper face of the image recording apparatus 1, there is provided a document cover 1*b* as a top panel of the image recording apparatus 1 so as to be openable and closable. Under the document cover 1*b*, there are provided a platen glass on which a document is placed, an image sensor which reads an image of the document, and so on.

On an upper portion of the front face of the image recording apparatus 1, there is provided an operation panel 11 for operating the printing section 2 and the scanning section 3. The operation panel 11 includes various types of operational buttons and a liquid crystal display 11*a* functioning as an information outputting portion configured to output information to a user. The image recording apparatus 1 can be operated on the basis of a command outputted from the operation panel 11, which command is based on an operation of the user with the operation panel 11. Where the image recording apparatus 1 is connected to an external computer, the image recording apparatus 1 can be operated on the basis of a command transmitted from the external computer via a printer driver or a scanner driver.

A slot portion 12 is provided in a left upper portion of the front face of the image recording apparatus 1. One or ones of various types of small-sized memory cards each as a storage media can be mounted in the slot portion 12. Data stored in the memory card mounted on the slot portion can be read by a predetermined operation of the user with the operation panel 11. Information based on the read data can be displayed on the liquid crystal display 11*a* of the operation panel 11. An image selected on the basis of the information can be recorded on the recording sheet by the printing section 2.

Figure 2:
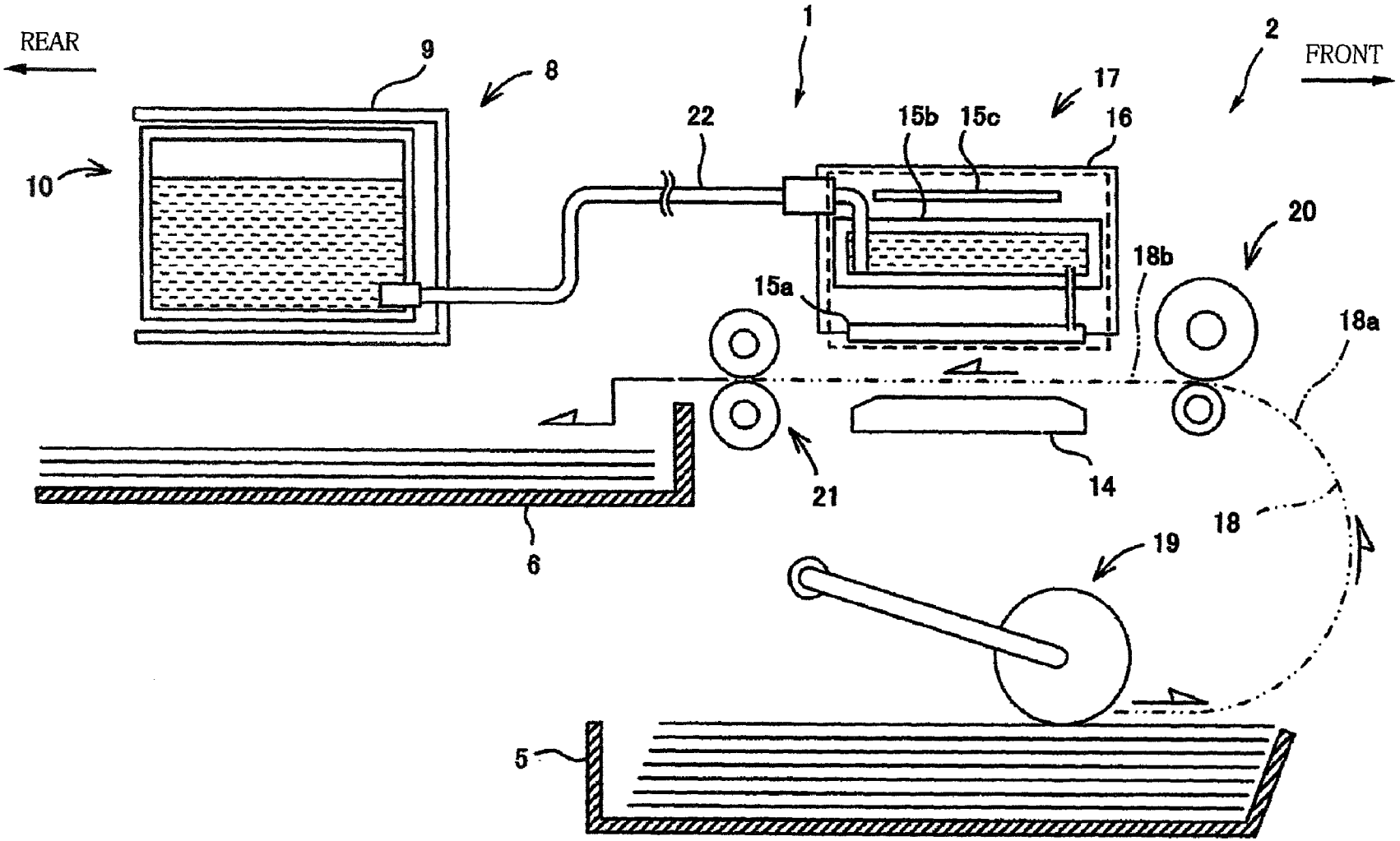
FIG. 2 is a cross sectional view schematically showing a construction of a printing section of the image recording apparatus.

As shown in FIG. 2, the sheet-supply tray 5 is provided near a bottom portion of the image recording apparatus 1. Above the sheet-supply tray 5, there is provided a platen 14 which has a flat plate shape and whose longitudinal sides extend in a left and right direction in FIG. 1. Above the platen 14, an image recording unit 17 is provided. The image recording unit 17 includes a head unit 15*a*, sub-tanks 15*b*, a head controlling board 15*c*, and so on. The head unit 15*a* ejects the inks from nozzle openings, not shown, the sub-tanks 15*b* supply the respective inks to the head unit 15*a*, and the head controlling board 15*c* provided by, e.g., chip on film (COF) outputs, to the head unit 15*a*, a drive signal to be transmitted to an actuator electrically connected to the head unit 16*a*. The sub-tanks 15*b* communicate with the respective cartridges 10 in the state of being mounted on the cartridge mount 8 via respective flexible tubes 22. The sub-tanks 15*b* temporarily store the respective inks supplied from the respective cartridges 10 and supply the respective stored inks to the head unit 15*a*.

A sheet-convey path 18 is provided so as to extend from a rear portion of the sheet-supply tray 5. The sheet-convey path 18 includes a curved path 18*a* and a straight path 18*b*. The curved path 18*a* initially extends upward from the rear portion of the sheet-supply tray 5, and then curves frontward. The straight path 18*b* extends frontward from an end point of the curved path 18*a*. The sheet-convey path 18 is defined, in a portion thereof other than a portion thereof at which the image recording unit 17 is disposed, by an outer guide face and an inner guide face which are faced to each other with a specific distance.

Just above the sheet-supply tray 5, there is provided a sheet-supply roller 19 which supplies the recording sheet in the sheet-supply tray 5 to the sheet-convey path 18. Near a downstream portion of the curved path 18*a* of the sheet-convey path 18, there are provided a pair of sheet-convey rollers 20 constituted by a sheet-convey roller and a pinch roller such that the sheet-convey path 18 is interposed between the pair of sheet-convey rollers 20 in a vertical direction. Near a downstream portion of the straight path 18*b* of the sheet-convey path 18, there are provided a pair of sheet-discharge rollers 21 constituted by a sheet-discharge roller and a pinch roller such that the sheet-convey path 18 is interposed between the pair of sheet-discharge rollers 21 in the vertical direction. The image recording unit 17 and the platen 14 are provided between the pair of sheet-convey rollers 20 and the pair of sheet-discharge rollers 21 such that the straight path 18*b* is interposed between the image recording unit 17 and the platen 14 in the vertical direction.

The image recording unit 17 is supported by a guide rod (not shown) extending in the left and right direction in FIG. 1 (i.e., the longitudinal direction of the platen 14) so as to be slidable in the left and right direction in FIG. 1. The image recording unit 17 is connected to a head driving mechanism (not shown) including a pulley, a belt, and so on. Thus, the image recording unit 17 can move and scan along the guide rod in the left and right direction in FIG. 1 within a predetermined area by driving the head driving mechanism.

In the printing section 2, the recording sheet in the sheet-supply tray 5 is supplied to the sheet-convey path 18 by the sheet-supply roller 19, and then is conveyed from the curved path 18*a* to the straight path 18*b* on the sheet-convey path 18 by the pair of sheet-convey rollers 20. The recording sheet that has reached the straight path 18*b* is subjected to image recording with the inks ejected by the head unit 15*a* of the image recording unit 17 facing to the straight path 18*b*. When the recording is finished, the recording sheet is discharged from the straight path 18*b* onto the sheet-discharge tray 6 by the pair of sheet-discharge rollers 21.

Figure 3B:
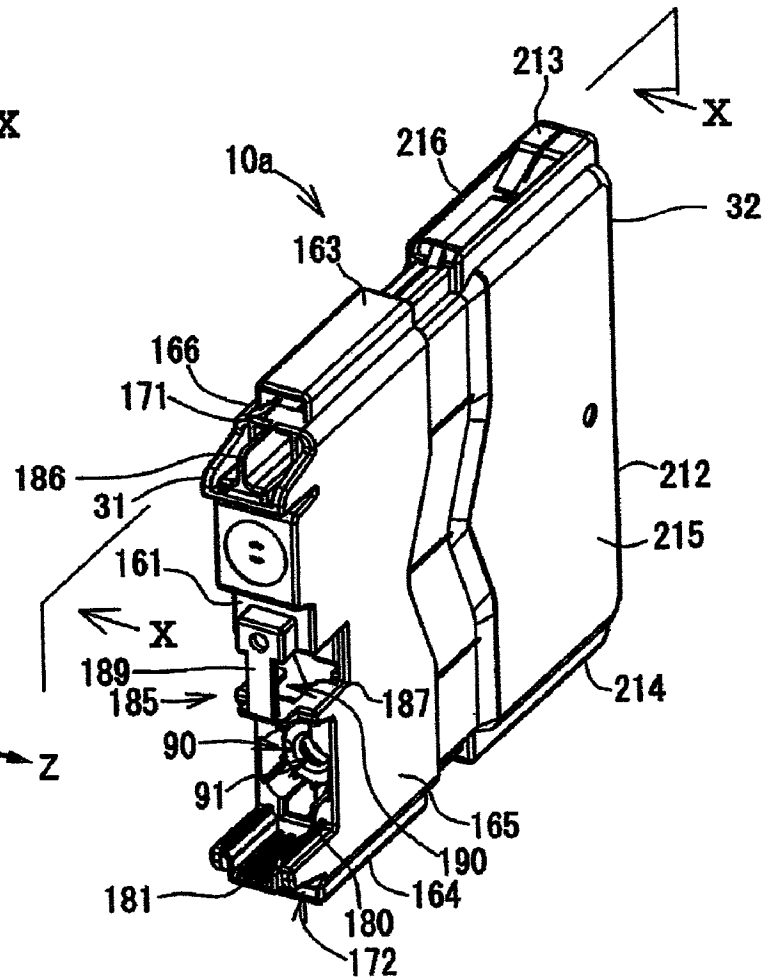
FIGS. 3A and 3B are perspective views each showing an external construction of a cartridge.

Meanwhile, there is a case that two types of the cartridges whose storage amounts of the ink are different from each other are distributed on the market although each of the two types of the cartridges stores the ink of the same color. In this image recording apparatus 1, a cartridge 10*a* (shown in FIGS. 3A and 3B) and a cartridge 10*b* (shown in FIGS. 12A and 12B) are distributed. In this image recording apparatus 1, each of the cartridges 10*a*, 10*b* can be mounted on the accommodating casing 9 in the cartridge mount 8.

Construction of One of Cartridges

Figure 3A:
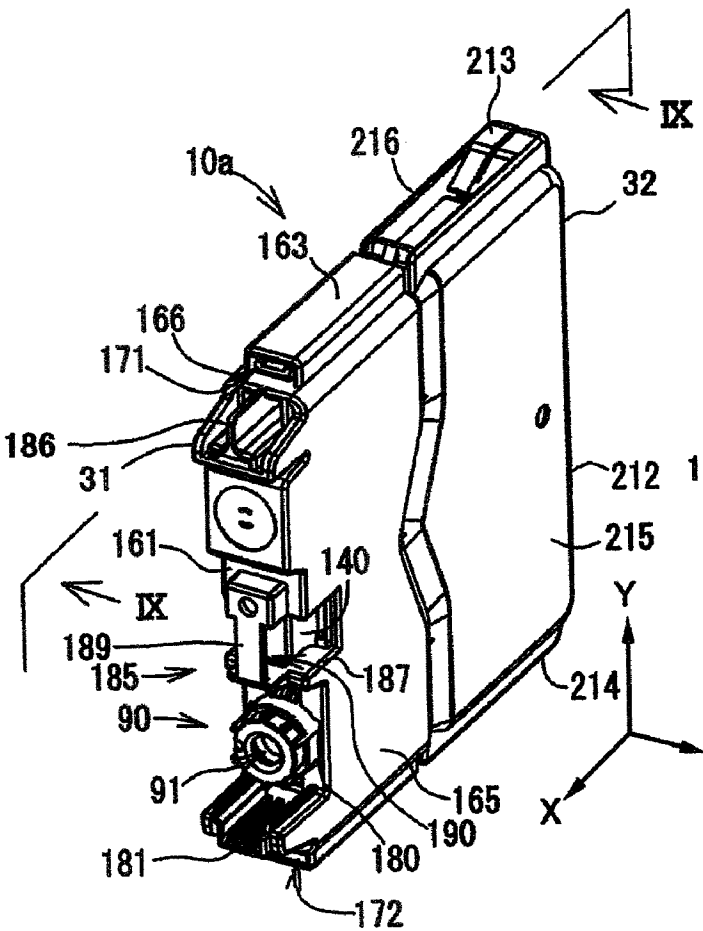
Figure 4A:
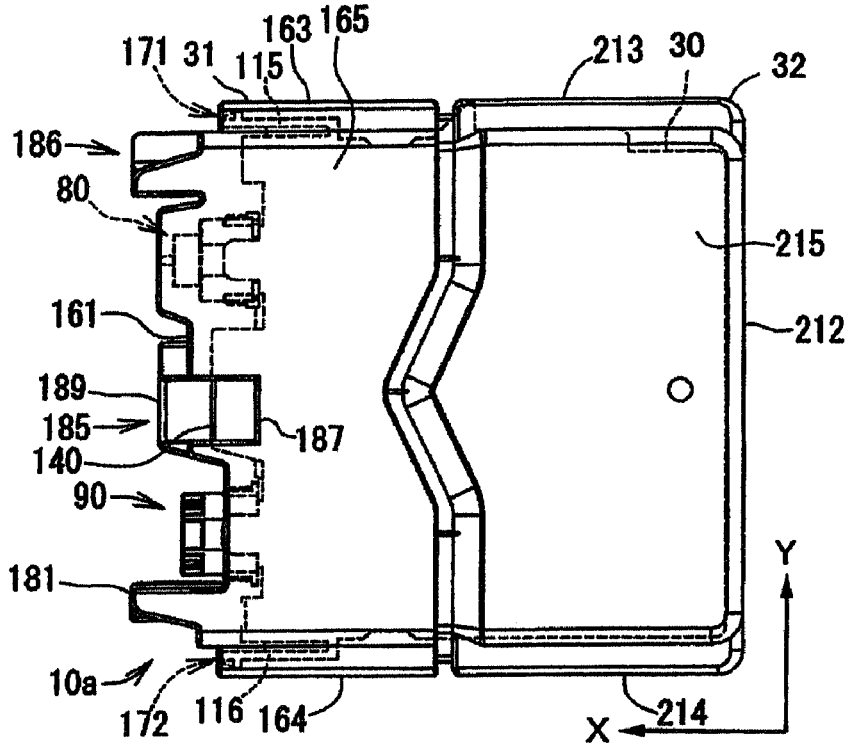
FIGS. 4A and 4B are side views each showing the cartridge shown in FIGS. 3A and 3B.
Figure 4B:
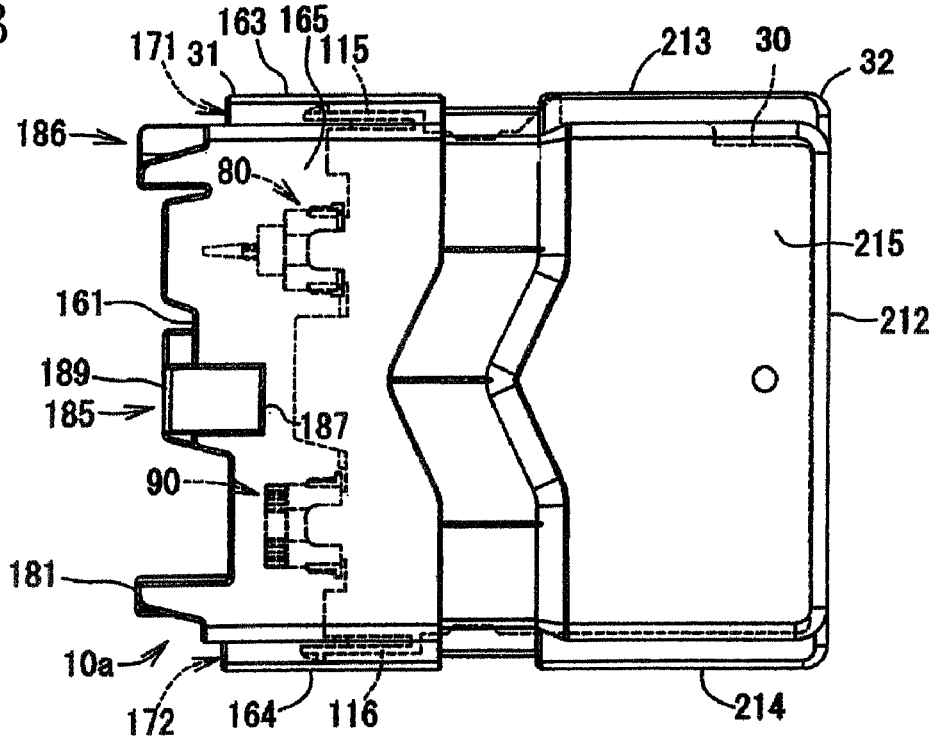

There will be next explained a construction of the cartridge 10*a* with reference to FIGS. 3A-11. It is noted that the following explanation is given for one cartridge 10*a*. The cartridge 10*a* used in this image recording apparatus 1 is extendable and contractable. FIGS. 3A and 4A show that the cartridge 10A is contracted, while FIGS. 3B and 4B show that the cartridge 10A is extended. It is noted that, in the following description, an explanation is given, taking a front side of the cartridge 10 in FIGS. 3A and 3B as a front portion of the cartridge 10 or the front and taking a rear side of the cartridge 10 in FIGS. 3A and 3B as a rear portion of the cartridge 10 or the rear.

As shown in FIGS. 3A and 3B and FIGS. 4A and 4B, the cartridge 10*a* has a generally flat hexahedron in a raised posture shown in FIGS. 3A and 3B and FIGS. 4A and 4B. The cartridge 10*a* has a rectangular parallelepiped shape having a relatively small width (in a direction indicated by "Z"), and a height (in a direction indicated by "Y") and a depth (indicated by "X") which are larger than the width. The cartridge 10*a* is moved in the direction indicated by "X" to be mounted on the cartridge mount 8 while taking the raised posture. The cartridge 10*a* includes a cartridge body 30, a front cover 31, and a rear cover 32. The cartridge body 30 shown in FIG. 4 stores the ink in an ink chamber 100 (shown in FIG. 5) in the cartridge body 30. The front cover 31 covers a front portion 30*a* of the cartridge body 30. The rear cover 32 covers a rear portion 30*b* of the cartridge body 30. In this image recording apparatus 1, the cartridge body 30, the front cover 31, and the rear cover 32 are formed of resin material such as nylon, polyethylene, or polypropylene. Hereinafter, there will be explained the cartridge body 30, the front cover 31, and the rear cover 32 of the cartridge 10*a* in order.

Cartridge Body

Figure 5B:
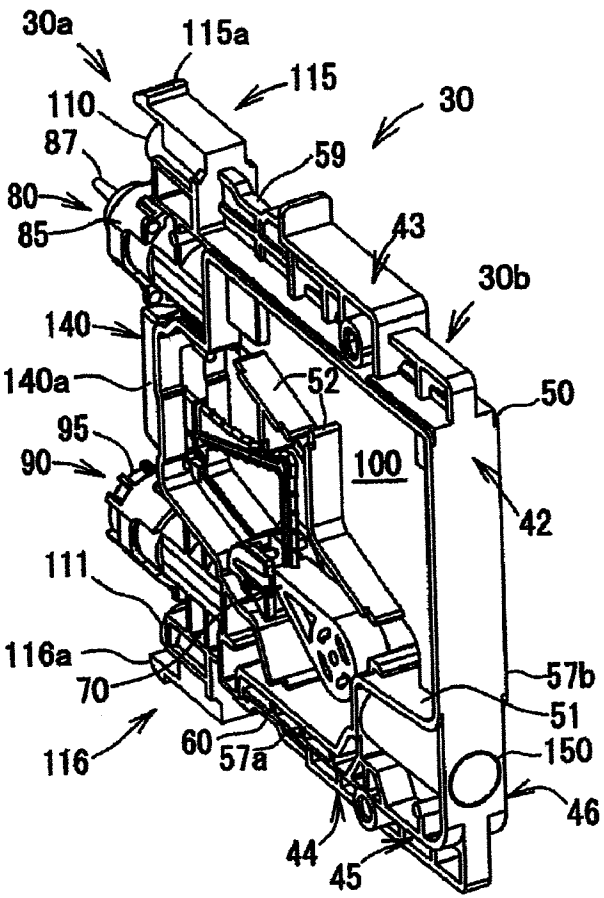
FIG. 5B is a perspective view showing an external construction of the cartridge body, seen obliquely from the rear.
Figure 5A:
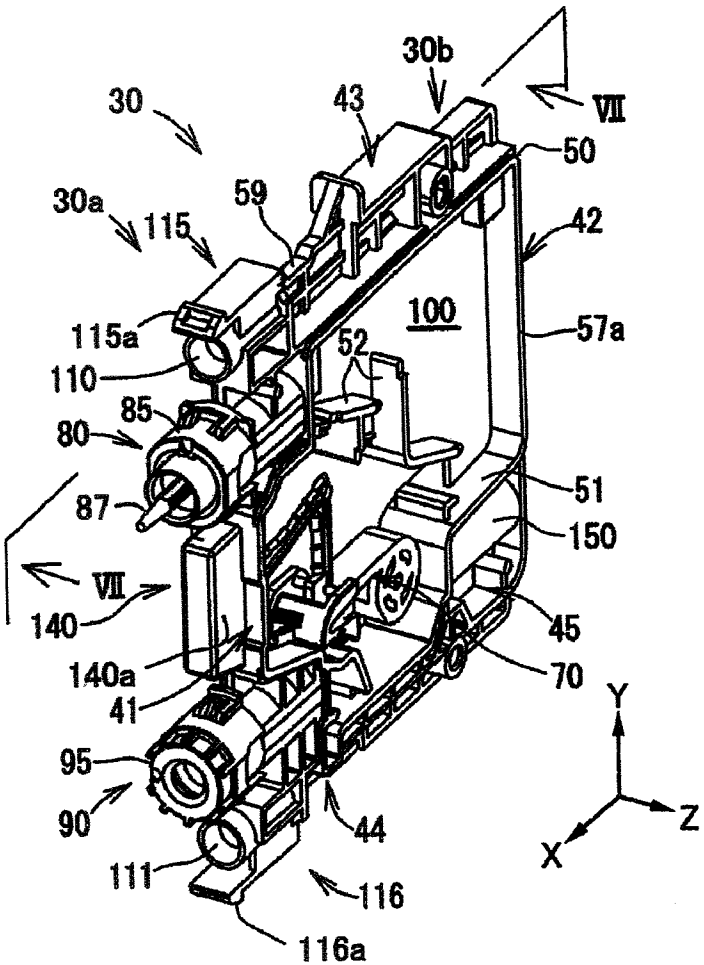
FIG. 5A is a perspective view showing an external construction of a cartridge body, seen obliquely from the front.
Figure 6:
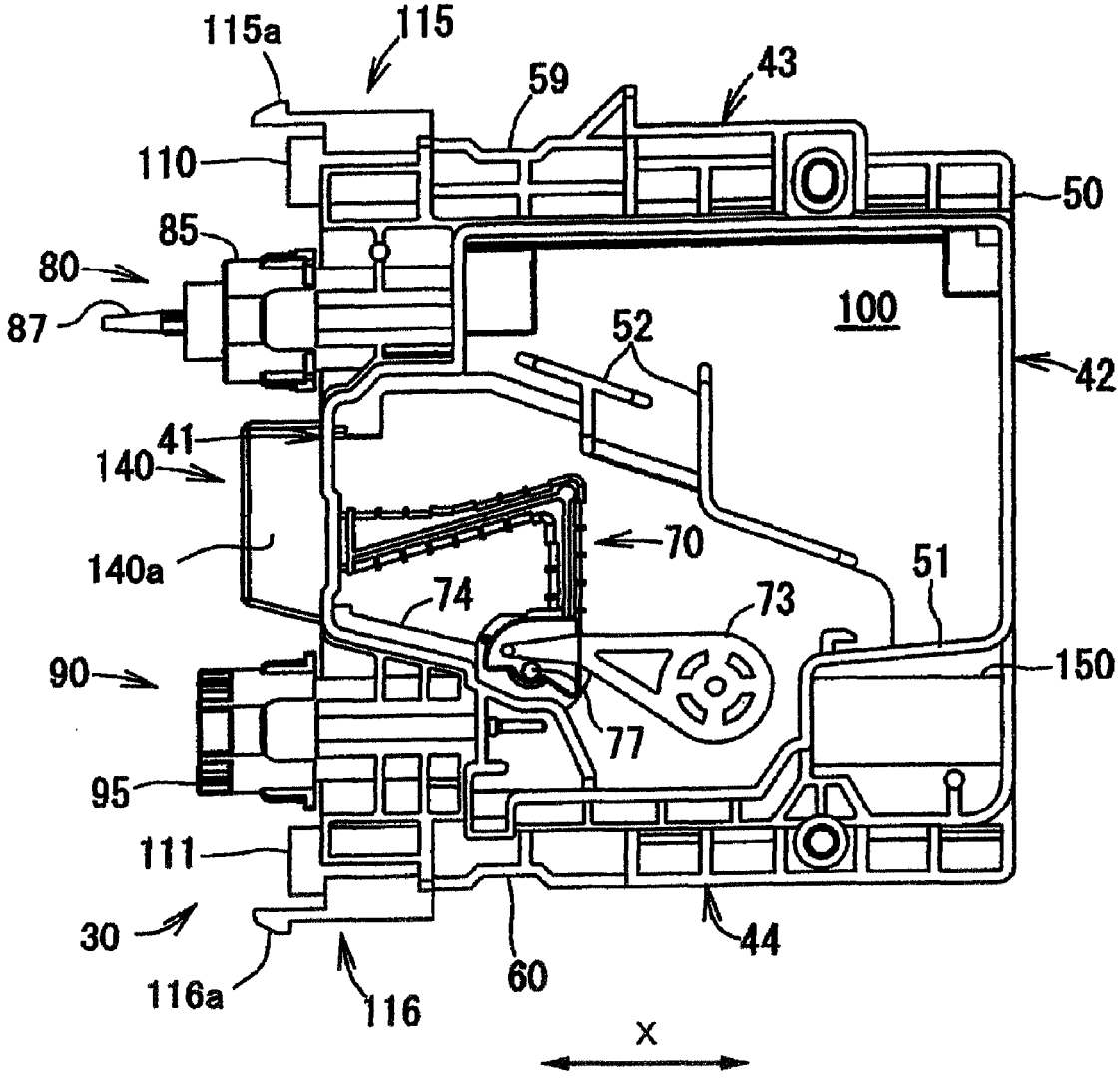
FIG. 6 is a side view of the cartridge body shown in FIG. 5.
Figure 7:
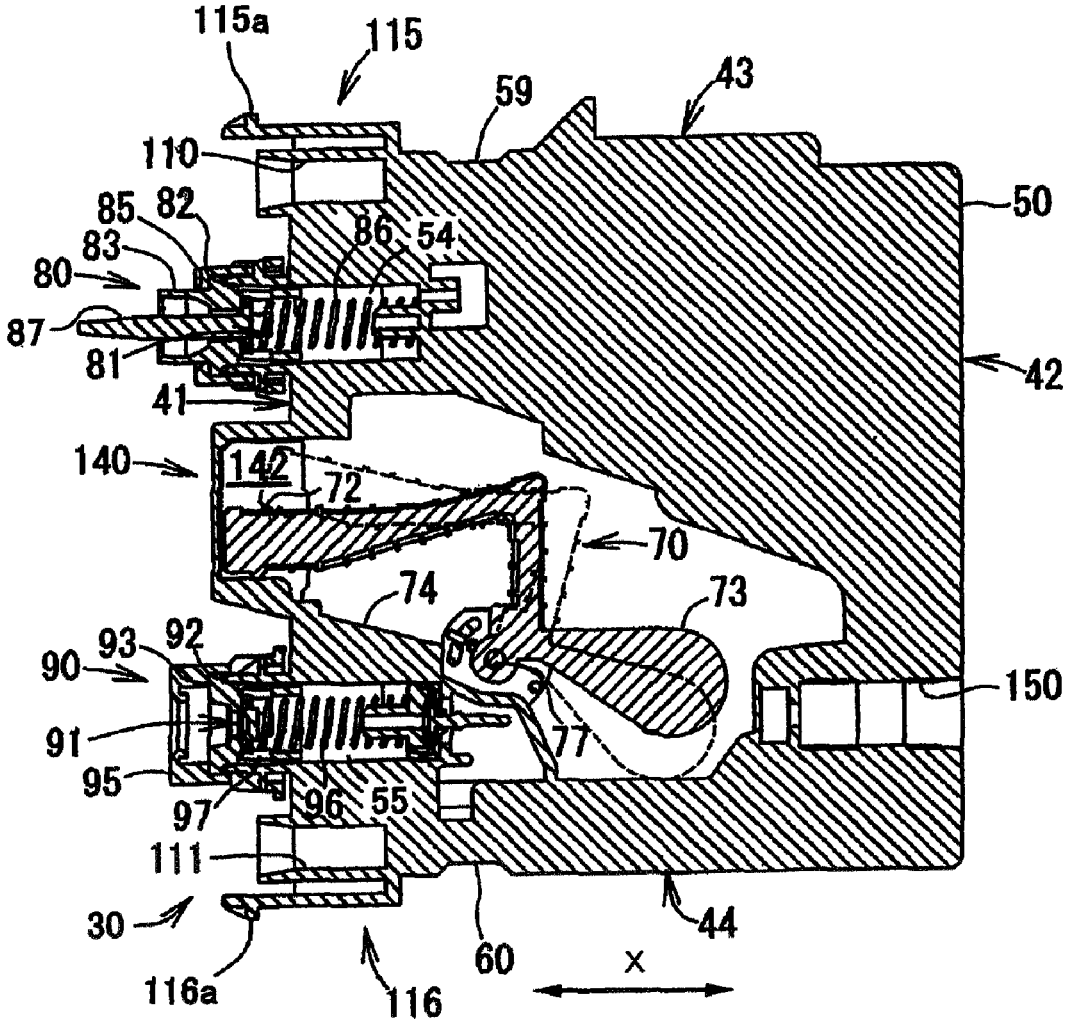
FIG. 7 is a cross sectional view of the cartridge body taken along a line VII-VII in FIG. 5.
Figure 8:
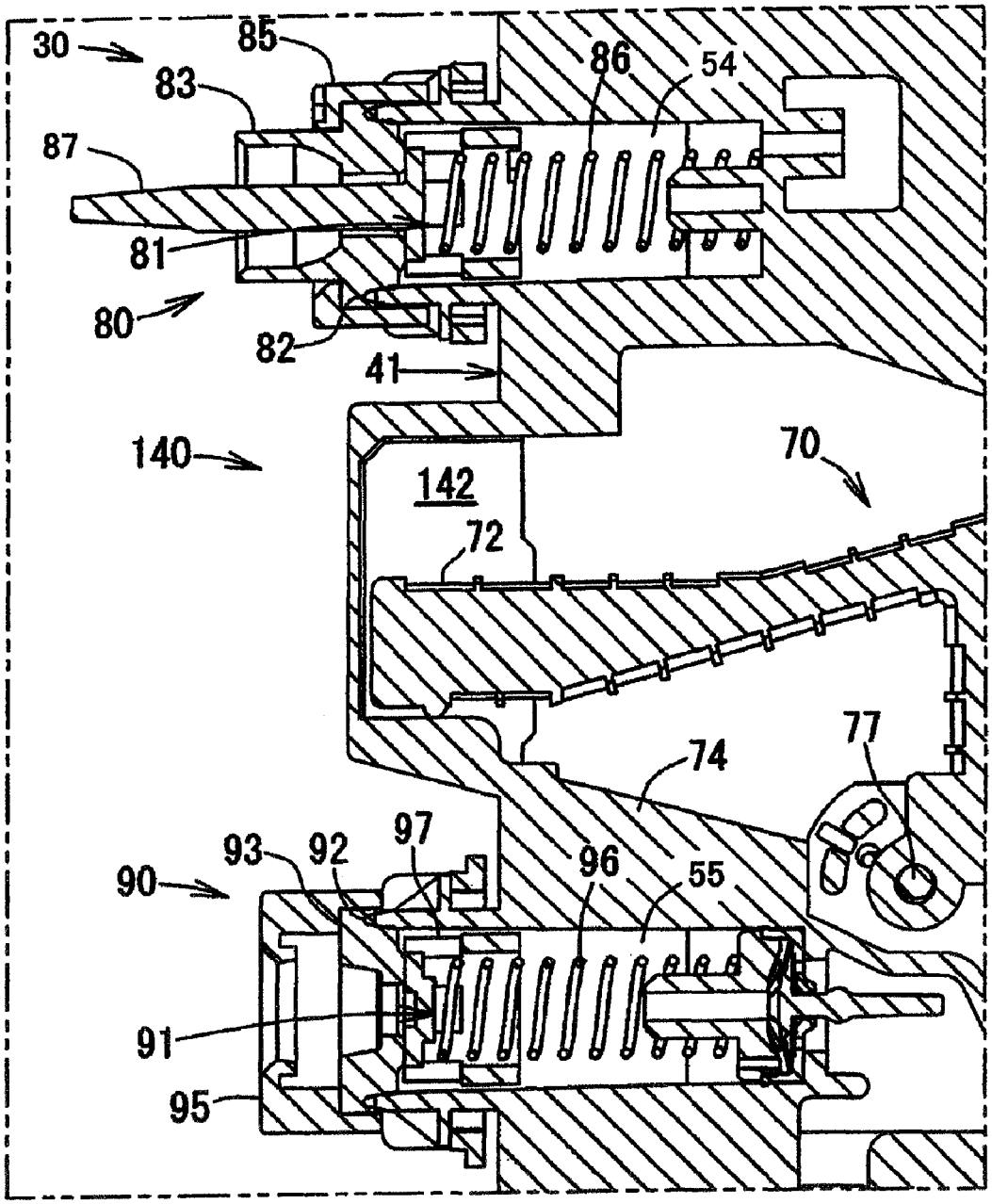
FIG. 8 is an enlarged cross sectional view showing a construction of a front portion of the cartridge body.

FIG. 5A is a perspective view showing an external construction of the cartridge body 30, seen obliquely from the front, and FIG. 5B is a perspective view showing an external construction of the cartridge body 30, seen obliquely from the rear. FIG. 6 is a side view of the cartridge body 30 shown in FIG. 5. FIG. 7 is a cross sectional view of the cartridge body 30 taken along a line VII-VII in FIG. 5. FIG. 8 is an enlarged cross sectional view showing a construction of the front portion 30*a* of the cartridge body 30.

As shown in FIGS. 5 and 6, the cartridge body 30 has a generally flat hexahedron like the cartridge 10*a*, and has a front face 41, a rear face 42, an upper face 43, a lower face 44, a left face 45, and a right face 46. Each of the front face 41 and the rear face 42 has a shape elongating in the vertical direction. The front face 41 is located on the front side of the cartridge 10*a* in an inserted direction (indicated by "X") in which the cartridge 10*a* is inserted, while the rear face 41 is located on the rear side of the cartridge 10*a* in the inserted direction. Each of the upper face 43 and the lower face 44 has a shape elongating in the inserted direction. The left face 45 and the right face 46 are respectively located on a left and a right side seen from the rear face 42 in the inserted direction, and each has a square shape. The cartridge body 30 further includes a frame 50, an arm 70, an air communicating valve 80, an ink supply valve 90, and a transparent film (not shown). The frame 50 functions as a casing body of the cartridge body 30. The arm 70 is for detecting a remaining amount of the ink. The transparent film defines the ink chamber 100 with the frame 50.

The frame 50 constitutes the casing body of the cartridge body 30 as described above, and provides faces 41-46. The frame 50 is formed of transparent or translucent resin material having translucency. For example, the frame 50 is formed by injection molding of a resin material such as polyacetal, nylon, polyethylene, or polypropylene.

As shown in FIGS. 5 and 6, the frame 50 includes an outer wall 51 and an inner wall 52. The outer wall 51 is formed so as to have an annular shape in a side view along the front face 41, the upper face 43, the rear face 42, and the lower face 44 of the cartridge body 30. The inner wall 52 is provided in the outer wall 51. The outer wall 51 and the inner wall 52 are formed integrally with each other. In the upper face 43 of the outer wall 51, there is formed a recessed portion 59 recessed downward. In the lower face 44 of the outer wall 51, there is formed a recessed portion 60 recessed upward. To left and right peripherals (respectively near the left face 45 and the right face 46) of the annular outer wall 51, thin films formed of transparent resin are respectively welded, whereby left and right openings 57*a*, 57*b* are closed. As a result, a space surrounded by the outer wall 51 and the films is defined as the ink chamber 100.

The inner wall 52 provided in the outer wall 51 has a width generally the same as the outer wall 51. The films are also welded to left and right ends (respectively near the left face 45 and the right face 46). Thus, the films are restricted from being loosened. Further, even when external forces are applied to the front cover 31 and the rear cover 32 toward the cartridge body 30, the inner wall 52 restricts deformation of the front cover 31 and the rear cover 32 by supporting inner faces of the front cover 31 and the rear cover 32.

As shown in FIG. 5, an ink inlet portion 150 is integrally formed on a lower rear portion of the frame 50. The ink inlet portion 150 is a tubular portion having a hole penetrated from the rear face 42 of the frame 50 toward the ink chamber 100 and functions as a passage through which the ink is introduced to the ink chamber 100.

In a generally central area, in the vertical direction, of a front portion of the frame 50, there is formed a detecting window 140 integrally with the frame 50 so as to project frontward from the front face 41. The detecting window 140 is for visually or optically detecting the remaining amount of the ink stored in the ink chamber 100 and is formed of the transparent or translucent resin material having translucency like the frame 50. The detecting window 140 is irradiated in the direction indicated by "Z" with light ejected from a first optical sensor 230 (e.g., a photo interrupter) described below attached to the cartridge mount 8. As shown in FIG. 5, the detecting window 140 has a hollow box shape having left and right side faces 140*a*, 140*a*. An inner space 142 of the detecting window 140 communicates with the ink chamber 100.

As shown in FIG. 7, the arm 70 includes an indicator portion 72 and a float portion 73 in the frame 50. The indicator portion 72 extends frontward while the float portion 73 extends rearward. A supporting shaft 77 located at a middle position between the indicator portion 72 and the float portion 73 is pivotably supported by a rib 74 which is provided on an inner surface of the outer wall 51 so as to project toward an inside of the outer wall 51. The indicator portion 72 enters into and retracts from the detecting window 140 by the pivotal movement of the arm 70. In a state in which the indicator portion 72 is located on an inside of the detecting window 140, the light emitted in the direction indicated by "Z" cannot pass through the detecting window 140. On the other hand, in a state in which the indicator portion 72 is located on an outside of the detecting window 140, the light emitted in the direction indicated by "Z" can pass through the detecting window 140. The float portion 73 is formed to be hollow, and thus functions as a buoyant portion relative to the ink stored in the ink chamber 100.

Where the ink chamber 100 is filled with the ink, the float portion 73 is positioned at a relatively higher position, while the indicator portion 72 is positioned at a relatively lower position and is located on the inside of the inner space 142 of the detecting window 140. When the ink is reduced from this state to an amount smaller than a predetermined amount, the float portion 73 starts to lower, whereby the arm 70 is pivotably moved about the supporting shaft 77 accordingly. Thus, the indicator portion 72 rises from the detecting window 140, and finally retracts from the detecting window 140. In a state in which the indicator portion 72 is located on the outside of the detecting window 140, the light emitted in the direction indicated by "Z" can pass through the detecting window 140. Thus, as described below, the optical sensor is for detecting whether the light can pass through the detecting window 140 or not, whereby the remaining amount of the ink in the ink chamber 100 can be detected.

Next, as shown in FIG. 7, the air communicating valve 80 is located above the detecting window 140 and is accommodated in a first valve accommodating chamber 54 formed in an upper portion of the front face 41 of the frame 50. As shown in FIG. 8, the first valve accommodating chamber 54 has an opening 82 which communicates with the ink chamber 100. The air communicating valve 80 is fitted to the opening 82, thereby functioning as a valve mechanism for opening and closing the opening 82.

Explained in more detail, the air communicating valve 80 includes a valve body 87, a spring 86, a sealing member 83, a cap 85, and so on. The valve body 87 has a rod shape and provided such that a front end of the valve body 87 projects from the opening 82 frontward. Each of the sealing member 83 and the cap 85 has a cylindrical shape. In a state in which the cap 85 is fitted on the sealing member 83, the cap 85 is fitted to the opening 82 of the first valve accommodating chamber 54. The valve body 87 is inserted through the sealing member 83 and slidable in a frontward and rearward direction (a direction indicated by "X"). Further, the spring 86 is provided in the first valve accommodating chamber 54, and forces the valve body 87 frontward from the rear.

In a state (shown in FIG. 8) in which the valve body 87 is positioned at a position where the valve body 87 is slid frontward by being forced by the spring 86, the air communicating valve 80 closes the opening 82 of the first valve accommodating chamber 54. On the other hand, in a state in which the valve body 87 is positioned at a position where the valve 87 is slid rearward against the force of the spring 86, an air communicating opening 81 is formed in a clearance between the opening 82 and the valve body 87, so that the ink chamber 100 is open to an atmosphere via the air communicating opening 81.

Next, as shown in FIG. 7, the ink supply valve 90 is located below the detecting window 140 and is accommodated in a second valve accommodating chamber 55 formed in a lower portion of the front face 41 of the frame 50. As shown in FIG. 8, the second valve accommodating chamber 55 has an opening 92 which communicates with the ink chamber 100. The ink supply valve 90 is fitted to the opening 92, thereby functioning as a valve mechanism for opening and closing the opening 92.

Explained in more detail, the ink supply valve 90 includes a valve body 97, a spring 96, a sealing member 93, a cap 95, and so on. The valve body 97 has a cylindrical shape whose axis extends in the frontward and rearward direction, and is provided in the opening 92 of the second valve accommodating chamber 55. Each of the sealing member 93 and the cap 95 has a generally cylindrical shape having a through hole extending in the frontward and rearward direction. In a state in which the cap 95 is fitted on the sealing member 93, the cap 95 is fitted to the opening 92. The valve body 97 is slidable in the frontward and rearward direction in the opening 92 (i.e., in the second valve accommodating chamber 55). Further, the spring 96 is provided in the second valve accommodating chamber 55, and forces the valve body 97 frontward from the rear.

In a state (shown in FIG. 8) in which the valve body 97 is positioned at a position where the valve body 97 is slid frontward by being forced by the spring 96, the ink supply valve 90 closes the opening 92 of the second valve accommodating chamber 55. On the other hand, the cartridge mount 8 includes an ink needle (not shown) provided at a position that corresponds to a position of the ink supply valve 90 when the cartridge 10 has been mounted on the cartridge mount 8. The ink needle presses and moves the valve body 97 rearward when the cartridge 10 is mounted on the cartridge mount 8. When the valve body 97 pressed and moved by the ink needle is positioned at its rear position against the force of the spring 96, an ink supply opening 91 is formed in a clearance between the opening 92 and the valve body 97. As a result, the ink chamber 100 communicates, via the ink supply opening 91, with the tube 22 connected to the cartridge mount 8, so that the ink in the ink chamber 100 is supplied to the sub-tank 15*b* (shown in FIG. 2) through the tube 22.

Figure 9:
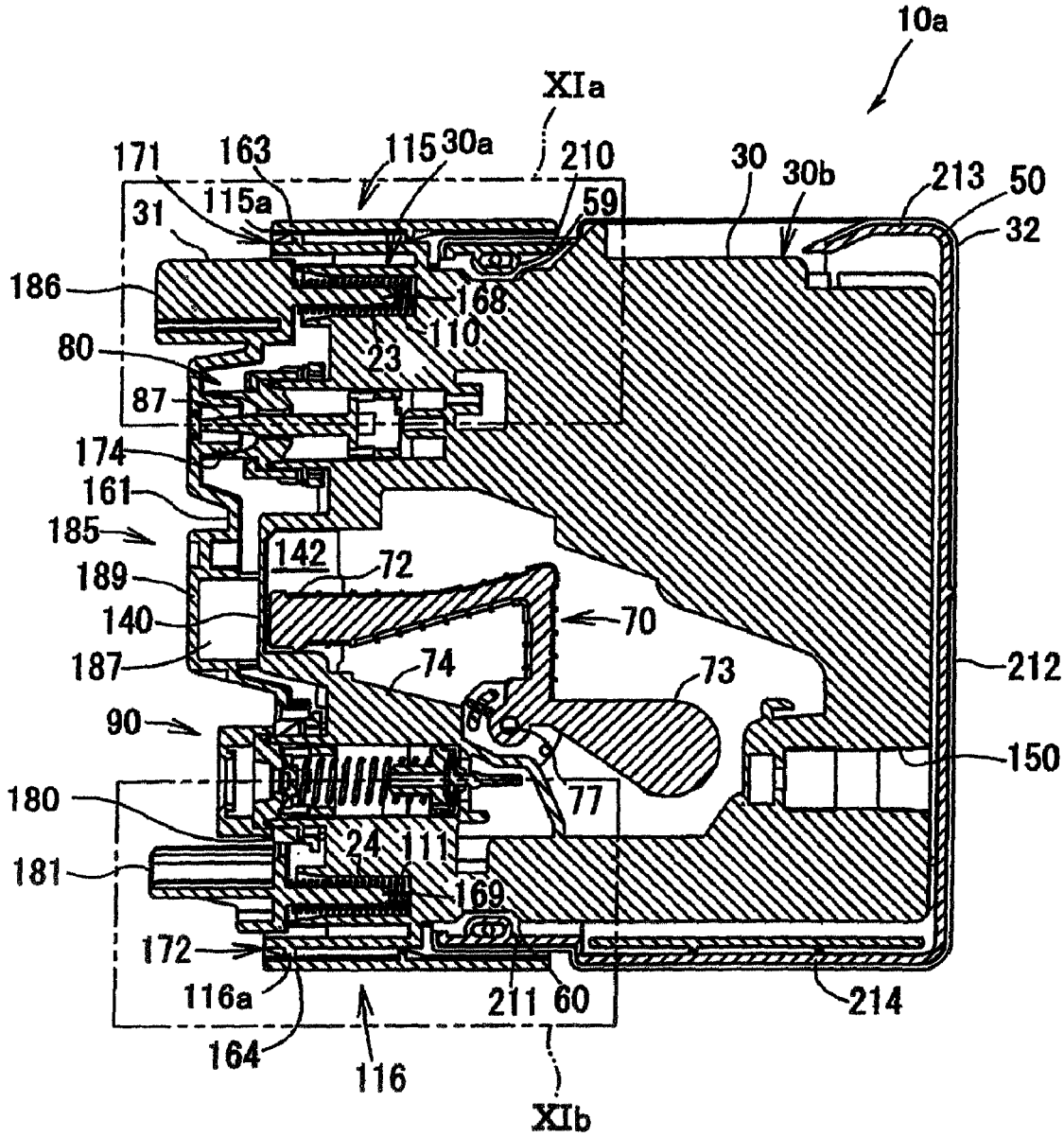
FIG. 9 is a cross sectional view showing a construction of the cartridge shown in FIG. 3A taken along a line IX-IX in FIG. 3A.

Meanwhile, as shown in FIG. 7, a first spring accommodating chamber 110 is formed above the first valve accommodating chamber 54 in the frame 50, while a second spring accommodating chamber 111 is formed under the second valve accommodating chamber 55. Each of the spring accommodating chambers 110, 111 is a hole having a bottom and formed from the front face 41 of the frame 50 toward the rear (i.e., toward the ink chamber 100). As shown in FIG. 9, the spring accommodating chambers 110, 111 respectively accommodate coil springs 23, 24 for forcing the front cover 31 frontward which is attached to a front portion of the cartridge body 30.

On a front end of the upper face 43 of the frame 50, a first cover supporting member 115 is formed. On a front end of the lower face 44, a second cover supporting member 116 is formed. The cover supporting members 115, 116 include respective rod portions extending frontward, and respective projections 115*a*, 116*a* each having a claw shape and formed on front ends of the respective rod portions. The cover supporting members 115, 116 support the front cover 31, which will be explained next, such that the front cover 31 is slidable, and restrict the front cover 31 from falling off the cartridge body 30.

Front Cover

Figure 10:
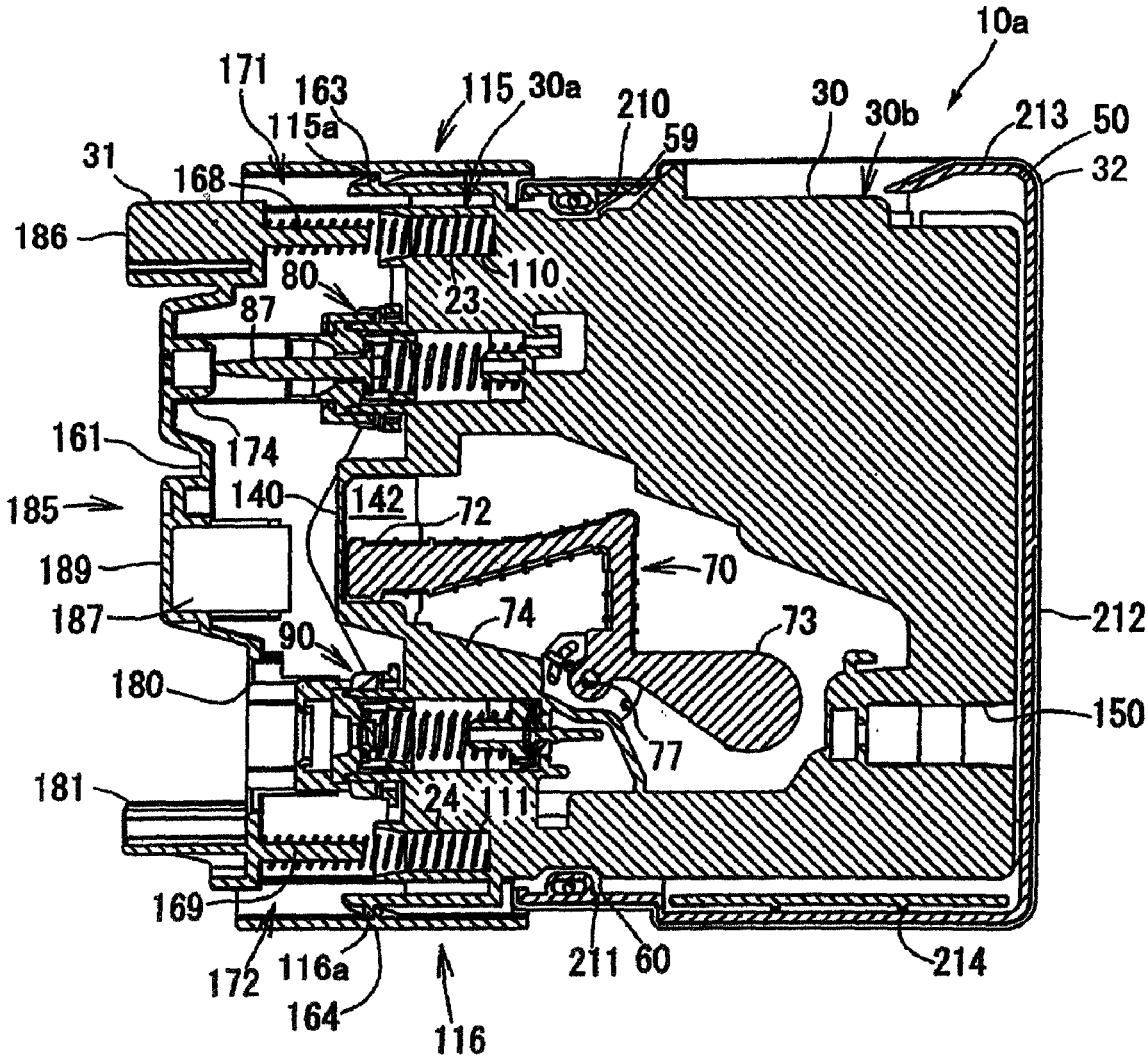
FIG. 10 is a cross sectional view showing a construction of the cartridge shown in FIG. 3B taken along a line X-X in FIG. 3B.
Figure 11A:
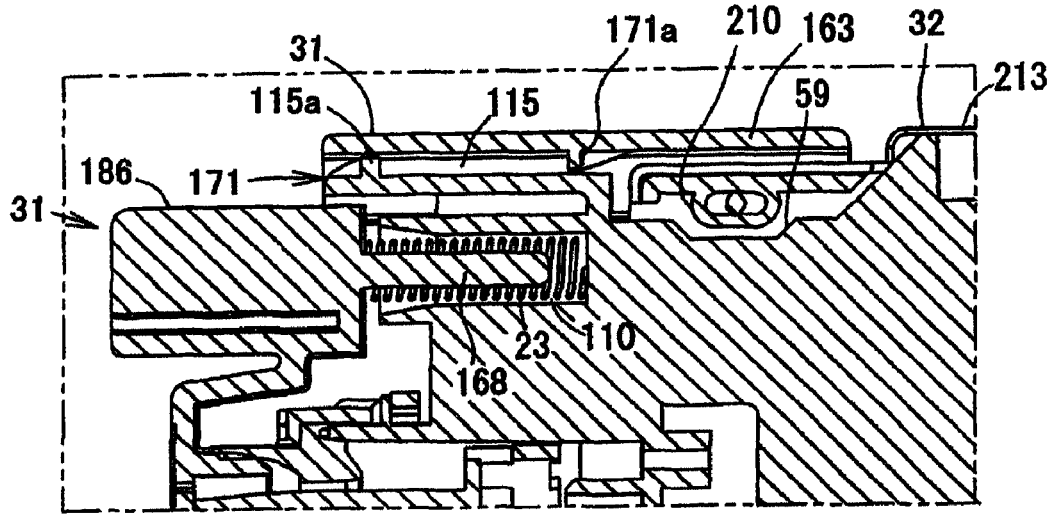
FIG. 11A is an enlarged view of an upper portion of the cartridge which is enclosed with a two-dot chain line XIa shown in FIG. 9.
Figure 11B:
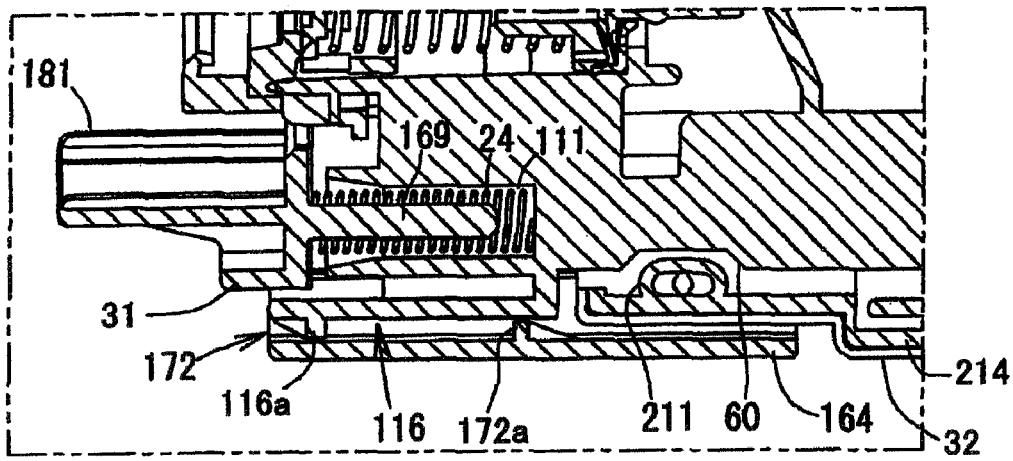
FIG. 11B is an enlarged view of a lower portion of the cartridge which is enclosed with a two-dot chain line XIb shown in FIG. 9.

FIG. 9 is a cross sectional view showing a construction of the cartridge 10*a* shown in FIG. 3A taken along a line IX-IX in FIG. 3A. FIG. 10 is a cross sectional view showing a construction of the cartridge 10*a* shown in FIG. 3B taken along a line X-X in FIG. 3B. FIG. 11A is an enlarged view of an upper portion of the cartridge 10*a* which is enclosed with a two-dot chain line XIa shown in FIG. 9, and FIG. 11B is an enlarged view of a lower portion of the cartridge 10*a* which is enclosed with a two-dot chain line XIb shown in FIG. 9.

As shown in FIG. 9, the front cover 31 is formed like a casing which can accommodate the front portion 30*a* of the cartridge body 30, and is flat in correspondence with a shape of the front portion 30*a* of the cartridge body 30. Further, the front cover 31 includes a front wall 161, an upper wall 163, a lower wall 164, a left wall 165, and a right wall 166. The front wall 161 corresponds to the front face 41 of the cartridge body 30. The upper wall 163 corresponds to the upper face 43. The lower wall 164 corresponds to the lower face 44. The left wall 164 corresponds to the left face 45. The right wall 166 corresponds to the right face 46. The front cover 31 can accommodate the front portion 30*a* of the cartridge body 30 in a space surrounded with these walls and being open to the rear. Further, the front cover 31 is provided with a first detected portion 185 and a second detected portion 186 which are respectively detected through the first optical sensor 230 and a second optical sensor 235 which will be described below, and a cutout portion 187 is formed in the front cover 31.

As shown in FIGS. 3 and 4, the cutout portion 187 is formed at a generally central portion, in the vertical direction, of the front wall 161 of the front cover 31 such that the front wall 161 is recessed rearward. Thus, left and right spaces of the front cover 31 communicate with each other. When the cartridge 10*a* has been mounted on the cartridge mount 8 in a state in which the front cover 31 is fitted on the cartridge body 30, the detecting window 140 is exposed to the outside through the cutout portion 187.

The first detected portion 185 is provided on a front side of the cutout portion 187, and includes a bridge portion 189 projecting frontward from portions of the front wall 161 which are respectively located on an upper and a lower side of the cutout portion 187. The bridge portion 189 is formed of resin material through which the light cannot pass, and has a plate-like shape having a relatively small thickness in the frontward and rearward direction. Between the bridge portion 189 and the cutout portion 187 (i.e., a position on a front side of the cutout portion 187), there is provided a clearance 190 (shown in FIG. 3). Like the cutout portion 187, this clearance 190 permits the left and right spaces of the front cover 31 to communicate with each other.

The second detected portion 186 is provided so as to project frontward from an upper portion of the front wall 161. This second detected portion 186 has a plate-like shape whose faces are directed in the left and right direction (i.e., in the direction indicated by "z"). Further, like the first detected portion 185, the second detected portion 186 is formed of the resin material through which the light cannot pass.

The front cover 31 is provided with a projected portion 181 and guide rods 168, 169. The projected portion 181 is initially brought into contact with a back face of the cartridge mount 8 in a mounting process in which the cartridge 10*a* is being mounted on the cartridge mount 8. The guide rods 168, 169 guide a sliding movement of the front cover 31 relative to the cartridge body 30. The projected portion 181 is formed integrally with the front cover 31 so as to project frontward from a lower portion of the front wall 161 of the front cover 31.

The guide rods 168, 169 respectively extend, like rods, rearward from upper and lower portions of a back face of the front wall 161 (that is, a rear face of the front wall 161 which is opposed to the front face 41 of the cartridge body 30). The upper guide rod 168 is inserted, from the front, into an inner bore of the coil spring 23 disposed in the first spring accommodating chamber 110 of the cartridge body 30. The lower guide rod 169 is inserted, from the front, into an inner bore of the coil spring 24 disposed in the second spring accommodating chamber 111 of the cartridge body 30.

Like the guide rods 168, 169, slide grooves 171, 172 which guide the sliding movement of the front cover 31 relative to the cartridge body 30 are respectively formed in a front portion of the upper wall 163 of the front cover 31 and in a front portion of the lower wall 164 of the front cover 31. The upper slide groove 171 is provided by forming the upper wall 163 of the front cover 31 so as to have an inverted, generally U-shape seen in a front view. The lower slide groove 172 is provided by forming the lower wall 164 of the front cover 31 so as to have a U-shape seen in the front view. At back (i.e., rear) portions of the slide grooves 171, 172, there are respectively provided projection pieces 171*a*, 172*a* projecting from respective groove surfaces of the slide grooves 171, 172.

Further, as shown in FIGS. 9 and 10, in the front cover 31, there is provided a pushing portion 174 between the first detected portion 185 and the second detected portion 186 disposed above the first detected portion 185. Further, an opening 180 is formed between the first detected portion 185 and the projected portion 181. The pushing portion 174 is provided on the back face of the front wall 161 of the front cover 31 at a position corresponding to the air communicating valve 80 of the cartridge body 30. When the front cover 31 and the cartridge body 30 are closer to each other, the pushing portion 174 pushes and presses the front end of the valve body 87 of the air communicating valve 80 toward the rear. The opening 180 is formed in the front wall 161 of the front cover 31 at a position corresponding to the ink supply valve 90.

There will be next explained a case where the front cover 31 is fitted on the cartridge body 30. When the front cover 31 is fitted on the cartridge body 30 by being closer to each other from a state in which the cartridge body 30 is positioned at a rear of the front cover 31, the first cover supporting member 115 is initially inserted into the upper slide groove 171, while the second cover supporting member 116 is inserted into the lower slide groove 172. Then, the projection 115*a* provided on the front end of the first cover supporting member 115 crosses over the projection piece 171*a* to enter into a rear portion of the slide groove 171, and the projection 116*a* provided on the front end of the second cover supporting member 116 crosses over the projection piece 172*a* to enter into a rear portion of the slide groove 172. Thus, even where the user tries to pull out the front cover 31 from the cartridge body 30 toward the front, the projections 115*a*, 116*a* and the projection pieces 171*a*, 172*a* are respectively snagged on each other, whereby the front cover 31 cannot be pulled out from the cartridge body 30.

When the front cover 31 is fitted on the cartridge body 30, the guide rods 168, 169 provided on the front cover 31 are respectively inserted into the inner bore of the spring 23 in the first spring accommodating chamber 110 of the cartridge body 30 and into the inner bore of the spring 24 in the second spring accommodating chamber 111 of the cartridge body 30. A direction of the sliding movement of the front cover 31 relative to the cartridge body 30 is restricted to the frontward and rearward direction by the guide rods 168, 169, and the front cover 31 is forced frontward by the springs 23, 24. Thus, when the external force is not applied, the front cover 31 is maintained to be distant from the cartridge body 30 in the frontward direction (shown in FIG. 10 and hereinafter referred to as a "first position"). On the other hand, when the external force is applied such that the front cover 31 is moved closer to the cartridge body 30, the front cover 31 is positioned closer to the cartridge body 30 (shown in FIG. 9, and hereinafter referred to as a "second position").

When the front cover 31 is slid from the first position to the second position, the pushing portion 174 of the front cover 31 pushes and presses the valve body 87 of the air communicating valve 80 toward the rear. As a result, the valve body 87 is pressed into the first valve accommodating chamber 54 against the force of the spring 86, so that the inside of the ink chamber 100 becomes open to the atmosphere. On the other hand, in this time, the ink supply valve 90 of the cartridge body 30 projects frontward through the opening 180 of the front cover 31. As a result, the valve body 97 of the ink supply valve 90 is pressed and moved rearward by the ink needle (not shown) provided on the cartridge mount 8 against the force of the spring 96, so that the ink in the ink chamber 100 is supplied to the sub-tank 15*b* (shown in FIG. 2) through the ink supply opening 91 and the tube 22.

Rear Cover

As shown in FIG. 9, the rear cover 32 is formed like a casing which can accommodate the rear portion 30*b* of the cartridge body 30, and is flat in correspondence with a shape of the rear portion 30*b* of the cartridge body 30. Further, the rear cover 32 includes a rear wall 212, an upper wall 213, a lower wall 214, a left wall 215, and a right wall 216. The rear wall 212 corresponds to the rear face 42 of the cartridge body 30. The upper wall 213 corresponds to the upper face 43. The lower wall 214 corresponds to the lower face 44. The left wall 215 corresponds to the left face 45. The right wall 216 corresponds to the right face 46. The rear cover 32 can accommodate the rear portion 30*b* of the cartridge body 30 in a space surrounded with these walls and being open to the front.

Projection pieces 210, 211 are respectively provided on respective inner faces of the upper wall 213 and the lower wall 214 of the rear cover 32. These projection pieces 210, 211 are respectively provided in correspondence with recessed portions 59, 60 respectively formed in the upper face 43 and the lower face 44 of the frame 50. When the rear cover 32 is fitted on the rear portion 30*b* of the cartridge body 30, the projection pieces 210, 211 are respectively fitted in the recessed portions 59, 60, whereby the cartridge body 30 and the rear cover 32 are reliably engaged with each other.

Construction of the Other of Cartridges

Figure 12B:
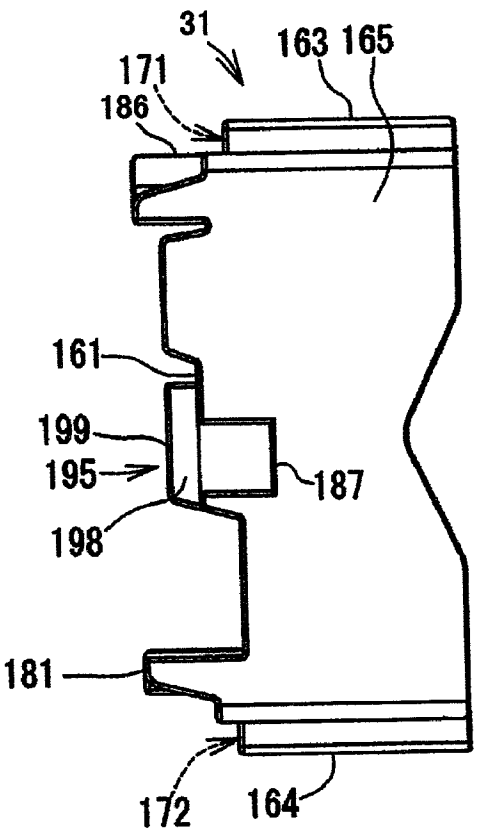
FIG. 12B is a side view of the front cover.
Figure 12A:
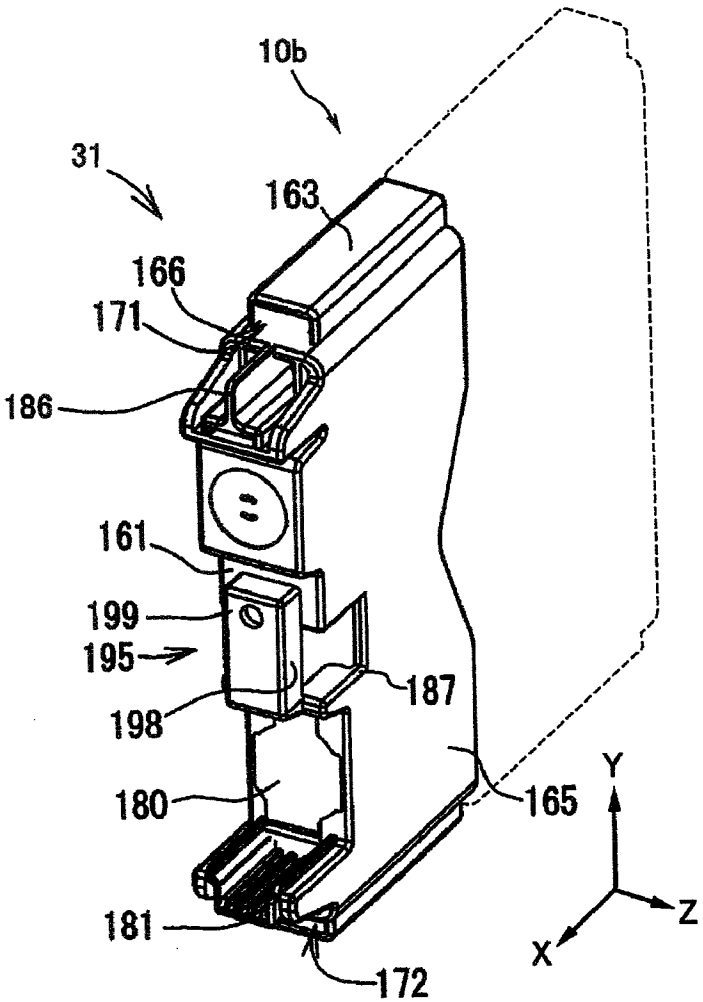
FIG. 12A is a perspective view showing a construction of a cartridge different from the cartridge shown in FIGS. 3A and 3B, with a front cover thereof shown in solid lines and the other portion thereof shown in broken lines.

Next, like the cartridge 10*a*, there will be next explained the cartridges 10*b* which are mounted on the cartridge mount 8 like the cartridge 10*a*. It is noted that the following explanation is given for one cartridge 10*b*. FIG. 12A is a perspective view showing a construction of the cartridge 10*b* with the front cover 31 shown in solid lines and the other portion of the cartridge 10*b* shown in broken lines, and FIG. 12B is a side view of the front cover 31. It is noted that the cartridge 10*b* is different from the cartridge 10*a* in that the front cover 31 of the cartridge 10*b* includes a first detected portion 195 which has a shape different from that of the above-described first detected portion 185 of the cartridge 10*a*. Thus, in the following description, only a construction of the first detected portion 195 will be explained, and the other portions of the cartridge 10*b* whose constructions are common to those of corresponding portions of the cartridge 10*a* are omitted. Further, for portions of the front cover 31 of the cartridge 10*b* whose constructions are common to corresponding portions of the front cover 31 of the cartridge 10*a*, the reference numerals as used to identify the corresponding portions of the cartridge 10*a* are used, and the explanation of the portions of the front cover 31 of the cartridge 10*b* will be partly dispensed with.

As shown in FIG. 12, like the above-described first detected portion 185, the first detected portion 195 of the cartridge 10*b* is formed of the resin material through which the light cannot pass, and is provided at a generally central portion, in the vertical direction, of the front wall 161 of the front cover 31. The first detected portion 195 includes a bridge portion 199 projecting frontward from portions of the front wall 161 which are respectively located on an upper and a lower side of the cutout portion 187. This bridge portion 199 is, unlike the bridge portion 189 of the cartridge 10*a*, provided with side walls 198 at left and right ends of the bridge portion 199. Thus, unlike the first detected portion 185 of the cartridge 10*a*, the clearance 190 through which the light passes between the bridge portion 189 and the cutout portion 187 is not formed. Instead of the clearance 190, the bridge portion 199 is provided with the side walls 198 for preventing the light from passing through the first detected portion 195 of the cartridge 10*b*.

Construction of Cartridge Mount

Figure 13:
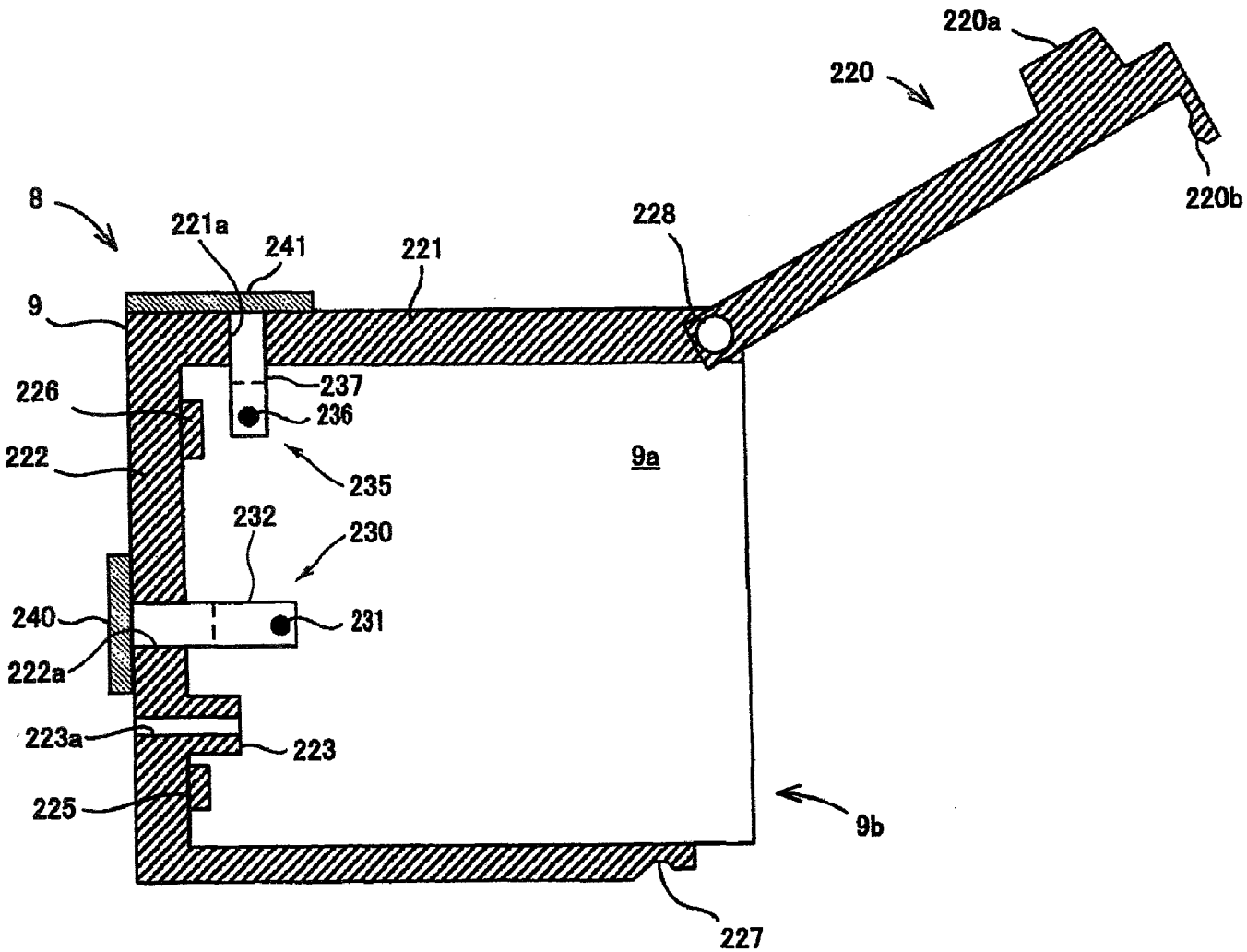
FIG. 13 is a cross sectional view schematically showing a construction of a cartridge mount.

FIG. 13 is a cross sectional view schematically showing a construction of the cartridge mount 8. As shown in FIG. 13, the cartridge mount 8 includes the accommodating casing 9 and a lock lever 220. In this image recording apparatus 1, the accommodating casing 9 is separated into five accommodating chambers 9*a* on which the cartridges 10 (the cartridges 10*a*, 10*b*) that respectively store the above-described inks of five colors are mounted. The lock lever 220 opens and closes an opening 9*b* of the accommodating casing 9. The accommodating casing 9 has a generally rectangular parallelepiped shape having the opening 9*b* in a rear portion (a right portion in FIG. 13) of the accommodating casing 9. A basal end portion of the lock lever 220 is pivotably supported by a rear end portion of an upper wall 221 of the accommodating casing 9. Thus, the lock lever 220 functions as a rectangular covering member which covers the opening 9*b* of the accommodating casing 9. Thus, the lock lever 220 is pivoted upward about the basal end portion thereof to expose the opening 9*b*, the cartridges 10 can be mounted in the respective accommodating chambers 9*a* through the opening 9*b*. Each of the first optical sensors 230 and a corresponding one of the second optical sensors 235 are respectively provided on a back portion (a left portion in FIG. 13) of a corresponding one of the accommodating chambers 9*a* in order to detect information about a corresponding one of the cartridges 10 which is in a state of being mounted on the accommodating chamber 9*a*.

Figure 14A:
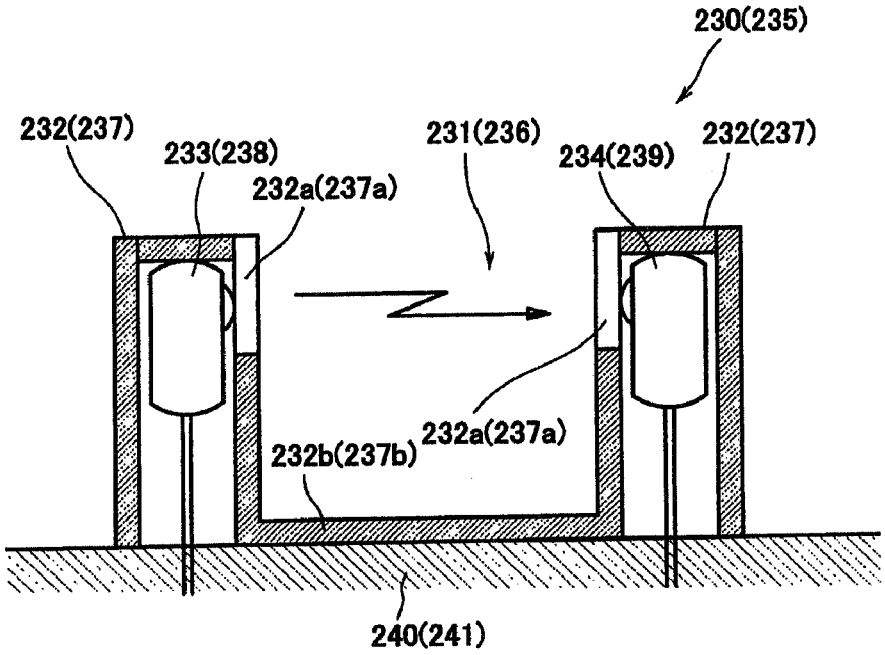
FIG. 14A is a cross sectional view schematically showing a construction of a first optical sensor.
Figure 14B:
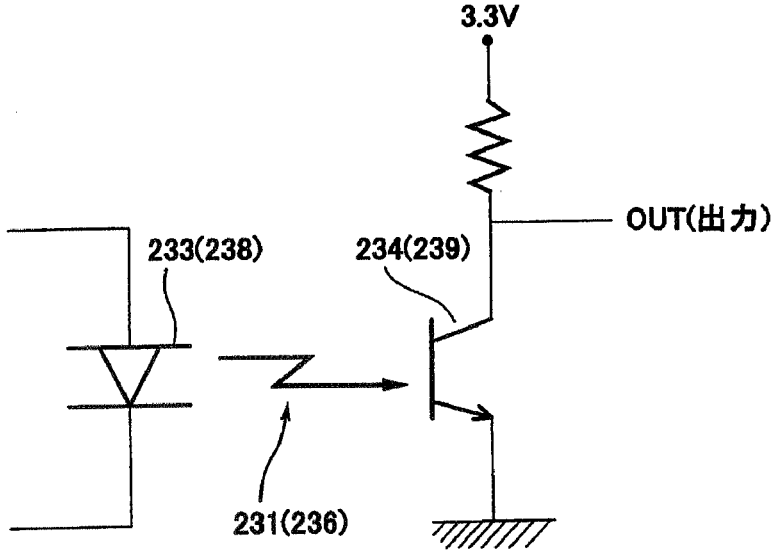
FIG. 14B is a schematic circuit diagram of the first optical sensor.

FIG. 14A is a cross sectional view schematically showing a construction of the first optical sensor 230, and FIG. 14B is a schematic circuit diagram of the first optical sensor 230. It is noted that the following explanation is given for one of the first optical sensors 230 and one of the second optical sensors 235. Further, since the first optical sensor 230 and the second optical sensor 235 have the same construction, numerals corresponding to those of the second optical sensor 235 are described in parentheses for portions or components of the first optical sensor 230 shown in FIG. 14 which correspond to those of the second optical sensor 235.

As shown in FIG. 14A, in this image recording apparatus 1, a photo interrupter is employed as the first optical sensor 230, and the first optical sensor 230 includes two hollow arms 232 as a pair which extend parallel to each other and are formed of resin. Basal portions 232*b* of the hollow arms 232 are connected to each other by a resin material. As a result, the first optical sensor 230 has a generally U-shaped external shape. In a distal end portion of one of the hollow arms 232, there is disposed a light-emitting element 233 provided by a light-emitting diode (shown in FIG. 14B). In a distal end portion of the other end of the hollow arms 232, there is disposed a light-receiving element 234 constituted by a photo diode (shown in FIG. 14B). These two hollow arms 232 are provided with a specific distance interposed therebetween. In parts of the distal end portions of the respective hollow arms 232 which are faced with each other, slits 232*a* are respectively formed through the respective hollow arms 232. Thus, when the light is emitted by an operation of the light-emitting element 233, the light is emitted through one of the slits 232*a*, and then received by the light-receiving element 234 through the other of the slits 232*a*. It is noted that respective shaft portions of the light-emitting element 233 and the light-receiving element 234 of the first optical sensor 230 are soldered to a sensor substrate 240, whereby the basal portion 232*b* is fixed to the sensor substrate 240, and the first optical sensor 230 is electrically connected to a main body of the image recording apparatus 1 via the sensor substrate 240.

Further, as seen in the circuit shown in FIG. 14B, in a state in which the light does not enter into the photo diode constituting the light-receiving element 234, the photo diode takes an "OFF" state, so that the first optical sensor 230 outputs a signal of a relatively "HIGH" level. On the other hand, in a state in which the light enters into the photo diode, the photo diode takes an "ON" state, so that the first optical sensor 230 outputs a signal of a relatively "LOW" level.

As shown in FIG. 13, the sensor substrate 240 including the first optical sensor 230 has a generally rectangular shape and provided at a generally central portion, in the vertical direction, of an outer face of a back wall 222 of the accommodating casing 9. On the sensor substrate 240, the five first optical sensors 230 for respective cartridges are arranged in a row in a longitudinal direction of the sensor substrate 240. Openings 222*a* are formed through the back wall 222 in correspondence with the respective five first optical sensors 230. Each pair of the hollow arms 232 are attached to the back wall 222 such that the pair of the hollow arms 232 extend toward the opening 9*b* via a corresponding one of the openings 222*a* and such that a corresponding one of the light-emitting elements 233 and a corresponding one of the light-receiving elements 234 are positioned in the left and right direction. Between the light-emitting element 233 and the light-receiving element 234, there is formed an area 231 functioning as a path of the light emitted from the light-emitting element 233 toward the light-receiving element 234 by the operation of the light-emitting element 233.

As described above, the second optical sensors 235 have the same constructions as the first optical sensors 230. Explained for one of the second optical sensors 235, the second optical sensor 230 includes a pair of hollow arms 237, 237, a light-emitting element 238 and a light-receiving element 239, and a basal portion 237*b*. The hollow arms 237 are provided parallel to each other with a specific distance interposed therebetween. The light-emitting element 238 and the light-receiving element 239 are respectively provided in distal end portions of the respective hollow arms 237. Basal portion of the hollow arms 237 are connected to each other by the basal portion 237*b*. Further, as shown in FIG. 14, slits 237*a* are respectively formed in distal end portions of the respective hollow arms 237 which are faced to each other. It is noted that respective shaft portions of the light-emitting element 238 and the light-receiving element 239 are soldered to a sensor substrate 241, whereby the basal portion 237*b* is fixed to the sensor substrate 241, and the second optical sensor 235 is electrically connected to the main body of the image recording apparatus 1 via the sensor substrate 241.

As shown in FIG. 13, the sensor substrate 241 including the second optical sensor 235 has a generally rectangular shape and provided at an outer face of a back portion of the upper wall 221 of the accommodating casing 9. On the sensor substrate 241, the five second optical sensors 235 for the respective cartridges are arranged in a row in a longitudinal direction of the sensor substrate 241. Openings 221*a* are formed through the upper wall 221 in correspondence with the respective five second optical sensors 235. Each pair of the hollow arms 237 are attached to the upper wall 221 such that the pair of the hollow arms 237 extend downward via a corresponding one of the openings 221*a* and such that a corresponding one of the light-emitting elements 238 and a corresponding one of the light-receiving elements 239 are positioned in the left and right direction. Between the light-emitting element 238 and the light-receiving element 239, there is formed an area 236 functioning as a path of the light emitted from the light-emitting element 238 toward the light-receiving element 239 by the operation of the light-emitting element 238.

It is noted that, as shown in FIG. 13, the light-emitting element 238 and the light-receiving element 239 of the second optical sensor 235 are disposed on a back side (left side of FIG. 13) of the light-emitting element 233 and the light-receiving element 234 of the first optical sensor 230 so as to be corresponded to the detected portions of the cartridge 10.

Further, as will be explained in more detail below, when the cartridge 10 is mounted on the cartridge mount 8, the controller 200 detects, through the first optical sensor 230, the type of the cartridge 10 and the remaining amount of the ink in the cartridge 10. Further, the controller 200 detects, through the second optical sensor 235, whether the cartridge 10 is in a mounting process in which the cartridge 10 is being mounted on the cartridge mount 8.

In a lower portion of the back wall 222 of the accommodating casing 9, there is provided a connecting portion 223 which is connected to the ink supply opening 91 of the cartridge 10. The connecting portion 223 has a cylindrical shape, and projects from the back wall 222 toward the opening 9*b* (i.e., rearward). The outside and the inside of the accommodating casing 9 communicate with each other through an inner hole 223*a* of the connecting portion 223. To the inner hole 223*a*, one of opposite ends of the tube 22 is connected while the other of the opposite ends of the tube 22 is connected to the sub-tank 15*b* (shown in FIG. 2). Further, an ink needle (not shown) is provided in the inner hole 223*a* of the connecting portion 223. When the cartridge 10 is mounted, the ink needle pushes and presses the valve body 97 of the ink supply valve 90 of the cartridge 10. As a result, the ink supply opening 91 and the inner hole 223*a* of the connecting portion 223 communicate with each other, whereby the ink in the ink chamber 100 can be supplied to the sub-tank 15*b* through the tube 22.

Contacting portions 225, 226 are respectively provided on an upper and a lower portion of the back wall 222 of the accommodating casing 9. The upper contacting portion 225 is provided in correspondence with the second detected portion 186 (shown in FIG. 10) provided on an upper portion of the cartridges 10. The contacting portion 225 receives a front end of the second detected portion 186 in the mounting process in which the cartridge 10 is being mounted. The lower contacting portion 226 is provided in correspondence with the projected portion 181 (shown in FIG. 10) provided on a lower portion of the cartridge 10. The contacting portion 226 receives a front end of the projected portion 181 in the mounting process in which the cartridge 10 is being mounted.

The lock lever 220 pivotably supported on the accommodating casing 9 not only opens and closes as the covering member which covers the opening 9*b* of the accommodating casing 9 as described above, but also steadily mounts and fixes the cartridge 10 on and to the accommodating chamber 9*a*. Described in more detail, the lock lever 220 is provided at a distal end portion thereof with (a) a grip 220*a* projecting outward so as to be gripped by the user, and (b) an engaging pawl 220*b* projecting inward so as to be engaged with the accommodating casing 9. On the other hand, in an end portion of the accommodating casing 9 which is located under the opening 9*b*, there is formed an engaging groove 227 which is engaged with the engaging pawl 220*b*. When the user pivots the lock lever 220 to cover the opining 9*b* while gripping the grip 220*a*, the engaging pawl 220*b* and the engaging groove 227 are engaged with each other, whereby the lock lever 220 steadily covers the opening 9*b* of the accommodating casing 9. Further, on a portion of the lock lever 220 at which the lock lever 220 is pivotably supported, there is provided an opening and closing sensor 228 through which whether the lock lever 220 is opened or closed can be detected. Further, this opening and closing sensor 228 functions as a mounting permission detecting sensor for detecting whether the mounting of the cartridge 10 on the cartridge mount 8 is permitted or inhibited.

Mounting of Cartridge

Figure 15:
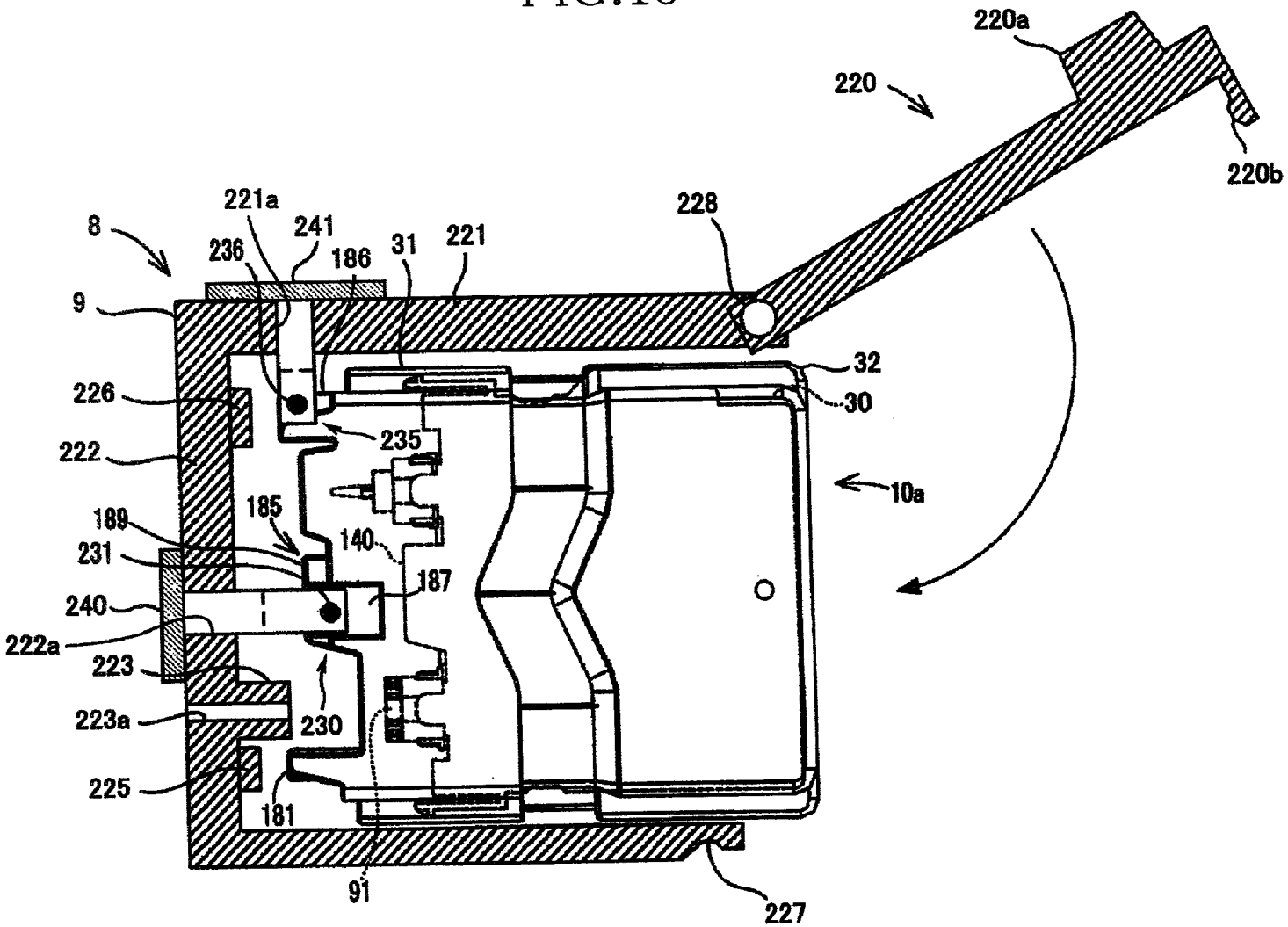
FIG. 15 is a cross sectional view schematically showing a state that a second detected portion is detected by a second optical sensor, in a mounting process in which the cartridge is being mounted on the cartridge mount.
Figure 16:
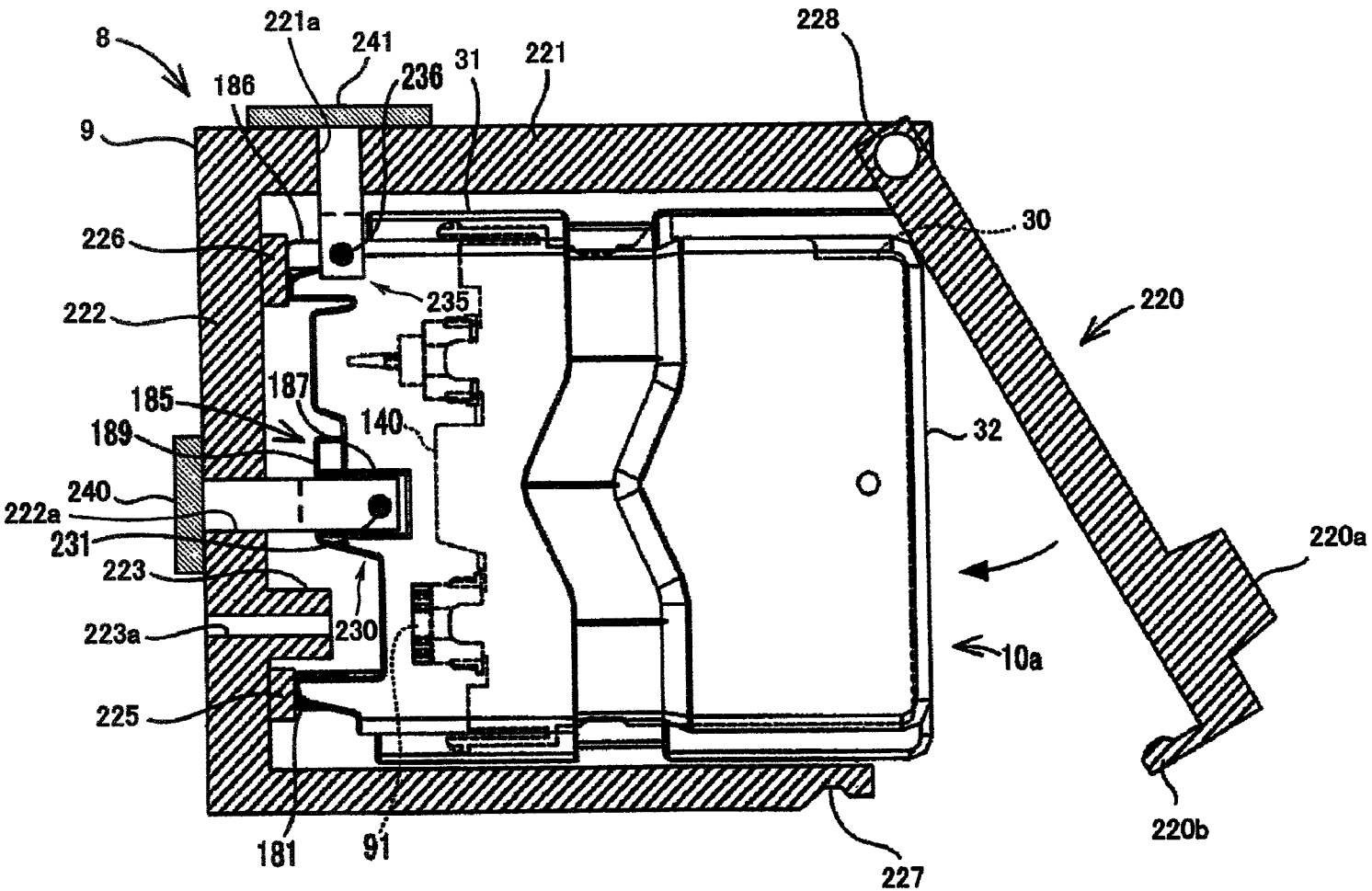
FIG. 16 is a cross sectional view schematically showing a state that front ends of the second detected portion and a projected portion are brought into contact with a back wall of an accommodating casing, in the mounting process in which the cartridge is being mounted on the cartridge mount.
Figure 17:
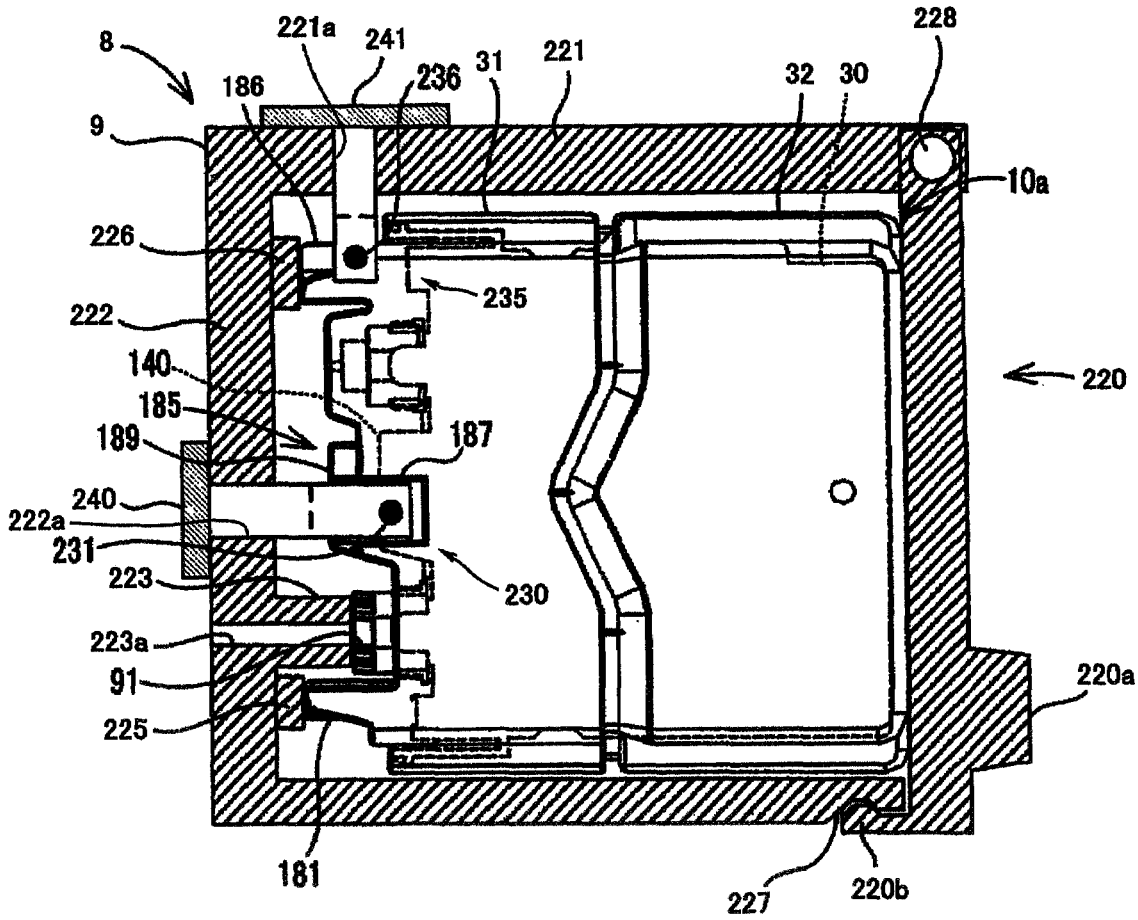
FIG. 17 is a cross sectional view schematically showing a state that the cartridge has been fully mounted in the accommodating casing, in the mounting process in which the cartridge is being mounted on the cartridge mount.

There will be next explained, with reference to FIGS. 15 through 17, a case where the cartridge 10*a* is mounted on the cartridge mount 8. Here, FIGS. 15 through 17 are cross sectional views each schematically shows the mounting process in which the cartridge 10*a* is being mounted on the cartridge mount 8. FIG. 15 shows a state that the second detected portion 186 is detected through the second optical sensor 235. FIG. 16 shows a state that front ends of the second detected portion 186 and the projected portion 181 are brought into contact with the back wall 222 of the accommodating casing 9. FIG. 17 shows a state that the cartridge 10*a* has been fully mounted on the accommodating casing 9.

As shown in FIG. 15, when most part of the cartridge 10*a* except for a rear end portion thereof has been inserted into the accommodating casing 9, the bridge portion 189 of the first detected portion 185 enters into the area 231 of the first optical sensor 230. Then, the cartridge 10*a* is further inserted backward, whereby the second detected portion 186 enters into the area 236 of the second optical sensor 235. In this time, the light ejected from the light-emitting element 233 of the first optical sensor 230 passes through the clearance 190 (shown in FIG. 3) of the first detected portion 185 to reach the light-receiving element 234.

Next, as shown in FIG. 16, in a state in which the front cover 31 is located at the first position at which the cover 31 is distant from the cartridge body 30, when the cartridge 10*a* is inserted into the most backward portion of the accommodating casing 9, the projected portion 181 of the cartridge 10*a* is brought into contact with the contacting portion 225, and the front end of the second detected portion 186 is brought into contact with the contacting portion 226, so that the front cover 31 cannot enter further frontward. In this time, the first detected portion 185 is positioned on a front side of the area 231 of the first optical sensor 230, the cutout portion 187 is entered into the area 231 instead of the clearance 190.

When the lock lever 220 is pivoted from a position thereof shown in FIG. 16 so as to cover the opening 9*b*, an inner face of the lock lever 220 is brought into contact with a rear end of the cartridge 10*a*, thereby pressing the cartridge 10*a* frontward. Then, the coil springs 23, 24 are contracted, so that the cartridge body 30 and the rear cover 32 are further moved or entered frontward so as to become closer to the front cover 31. In the process of entering, the ink supply opening 91 of the cartridge 10*a* is connected to the connecting portion 223, while the detecting window 140 of the cartridge body 30 is moved frontward to be exposed from the cutout portion 187, and the detecting window 140 enters into the area 231 of the first optical sensor 230.

As shown in FIG. 17, when the opening 9*b* is fully covered by the lock lever 220, and the engaging pawl 220*b* is fitted in the engaging groove 227, the lock lever 220 is locked relative to the opening 9*b*, so that the opening 9*b* is fully closed by the lock lever 220. In this time, the cartridge body 30 has reached the second position at which a distance between the cartridge body 30 and the front cover 31 is the shortest, so that the valve body 87 of the air communicating valve 80 is pushed and moved rearward from the pushing portion 174 of the front cover 31, and thus the inside of the ink chamber 100 is open to the atmosphere. As a result, a back pressure of the ink in the ink chamber 100 becomes equal to an atmospheric pressure, thereby permitting the ink to be supplied from the ink supply opening 91.

Functional Configuration of Image Recording Apparatus

Figure 18:
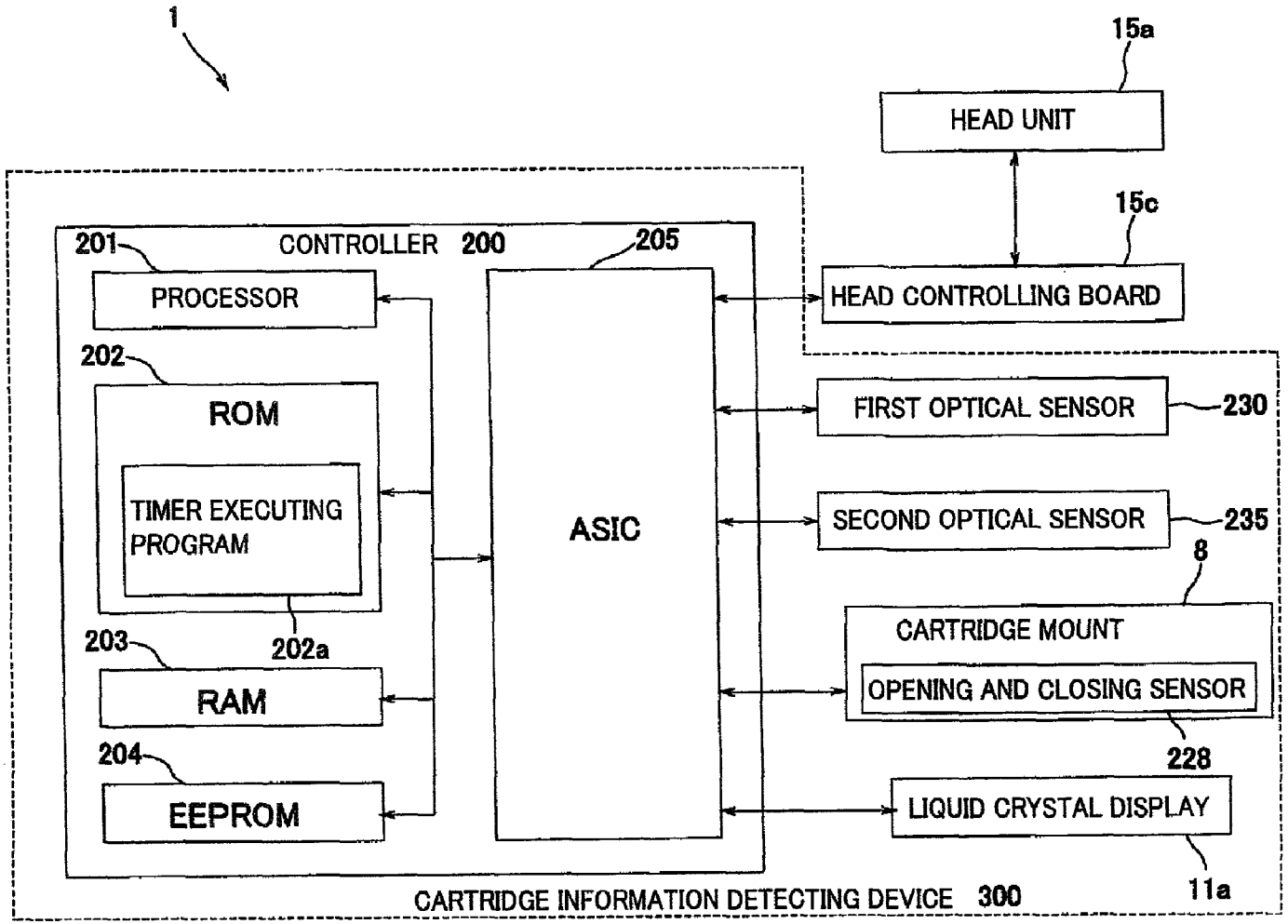
FIG. 18 is a block diagram showing main functions of the image recording apparatus.

FIG. 18 is a block diagram showing main functions of the image recording apparatus 1. As shown in FIG. 18, the image recording apparatus 1 includes a controller 200 configured to execute controls for operations of the image recording apparatus 1. The controller 200 includes a processor 201, a ROM 202, a RAM 203, an EEPROM 204, and an Application Specific Integrated Circuit (ASIC) 205.

The ROM 202 stores programs required for the processor 201 to execute controls for various operation of the image recording apparatus 1. For example, the ROM 202 stores a timer executing program 202*a* for measuring time. The RAM 203 is used as a storage area for temporarily storing various data used when the processor 201 executes the programs, or as a working area used when the processor 201 executes the programs. The EEPROM 204 stores settings, flags, and the like to be stored or kept after a power of the image recording apparatus 1 is turned off.

To the ASIC 205, there are connected the head controlling board 15*c*, the first optical sensor 230, the second optical sensor 235, the opening and closing sensor 228, the liquid crystal display 11*a*, and so on which are provided on an outside of the controller 200. It is noted that, although not shown in FIG. 18, in addition to these components, driving circuits for driving the sheet-supply roller 19, the pair of sheet-convey rollers 20, the pair of sheet-discharge rollers 21, and so on are connected to the ASIC 205.

The head controlling board 15*c* is electrically connected to the head unit 16*a*, and drives the head unit 15*a* on the basis of signals inputted from the ASIC 205. As a result, the ink(s) of desired color(s) is or are selectively ejected from the nozzle openings of the head unit 15*a* at specific timings, so that the image is recorded on the recording sheet.

The first optical sensor 230 outputs a signal (hereinafter, may be referred to as a light-receiving signal) according to an intensity (amount) of the light received by the light-receiving element. Specifically, the light is emitted from the light-receiving element 234 of the first optical sensor 230, and an analog electric signal (a voltage signal or a current signal) according to the intensity of the light received by the light-receiving element 234 of the first optical sensor 230 is outputted as the light-receiving signal from the first optical sensor 230. The outputted light-receiving signal is inputted to the controller 200. Where an electric level (a value of the voltage signal or a value of the current signal) of the light-receiving signal is equal to or higher than a predetermined threshold, the controller 200 judges that the signal is a HIGH level signal. On the other hand, where the electric level is lower than the threshold, the controller 200 judges that the signal is a LOW level signal. In this image recording apparatus 1, the light-receiving signal is judged to the HIGH level signal where the light is shielded in the area 231 of the first optical sensor 230. On the other hand, the light-receiving signal is judged to the LOW level signal where the light is not shielded in the area 231 of the first optical sensor 230.

The second optical sensor 235 operates on the basis of a principle the same as a principle on the basis of which the first optical sensor 230 operates, and outputs the light-receiving signal according to the intensity (amount) of the light received by the light-receiving element. Thus, a detailed explanation of the operation of the second optical sensor 235 is omitted.

The opening and closing sensor 228 outputs a specific signal which indicates that the mounting of the cartridge 10 on the cartridge mount 8 is permitted, when the lock lever 220 is opened to a specific degree of the opening. This signal is inputted to the controller 200. On the basis of this signal, the controller 200 judges whether the lock lever 220 is opened or not. Further, on the basis of a signal inputted from the ASIC 205, the liquid crystal display 11*a* outputs information, such as a character string and symbol marks, which is recognizable by the user.

In this image recording apparatus 1, the controller 200, the first optical sensor 230, the second optical sensor 235, the opening and closing sensor 228, the liquid crystal display 11*a*, and so on constitute a cartridge information detecting device 300 configured to detect information about the cartridge 10.

Output Waveform of Optical Sensors

Figure 19:
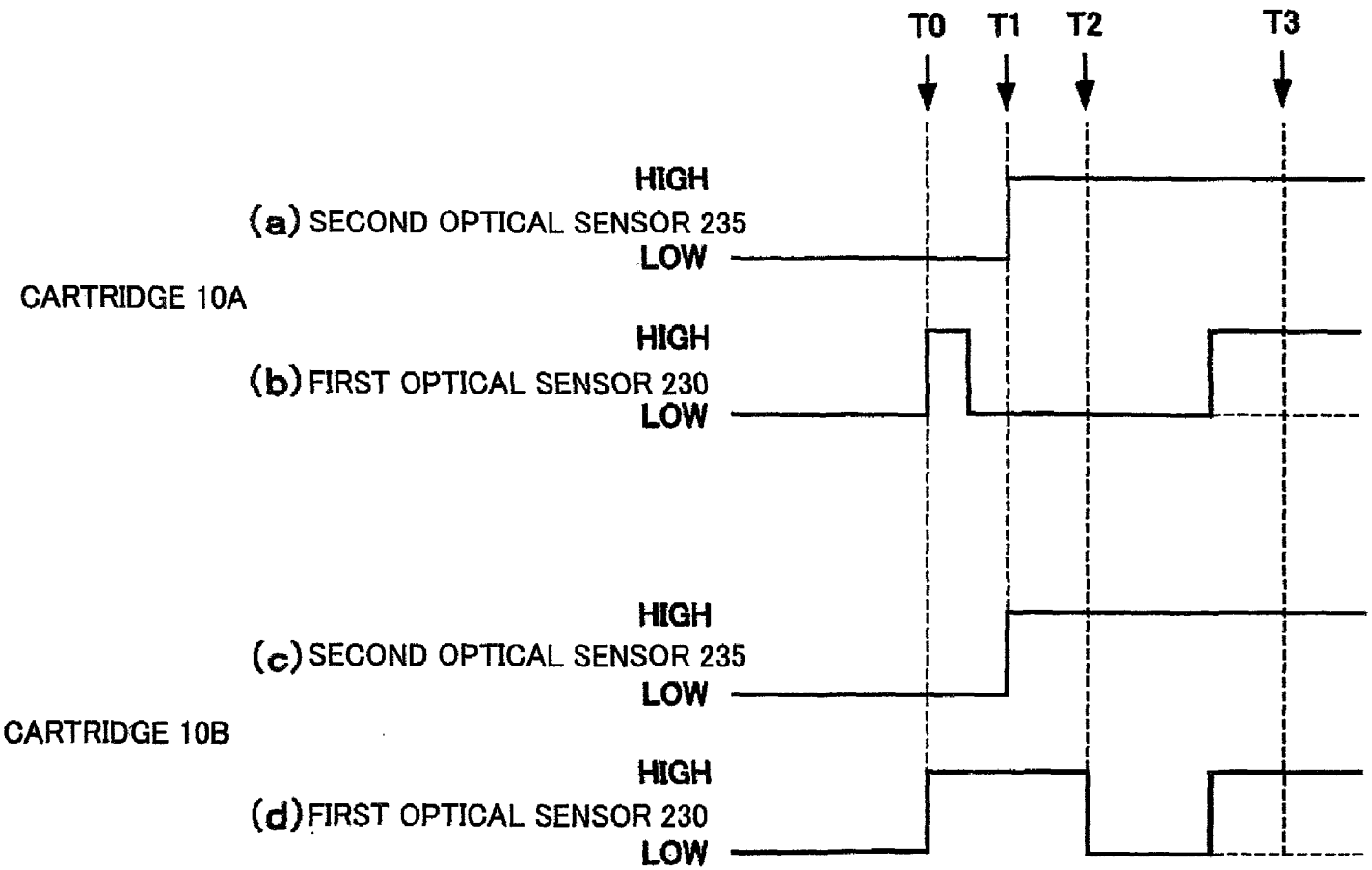
FIG. 19 is a view showing changes of waveforms, in a time series, in a signal level of a light-receiving signal inputted into a controller from the first optical sensor and the second optical sensor.

FIG. 19 is a view showing changes of waveforms, in a time series, in the signal level of the light-receiving signal inputted into the controller 200 from the first optical sensor 230 and the second optical sensor 235. Further, each of charts (a) and (b) shows the change of the waveform when the cartridge 10*a* is mounted. The chart (a) shows the change of the waveform of the light-receiving signal outputted from the second optical sensor 235, while the chart (b) shows the change of the waveform of the light-receiving signal outputted from the first optical sensor 230. Furthermore, each of charts (c) and (d) shows the change of the waveform when the cartridge 10*b* is mounted. The chart (c) shows the change of the waveform of the light-receiving signal outputted from the second optical sensor 235, while the chart (d) shows the change of the waveform of the light-receiving signal outputted from the first optical sensor 230.

As shown in FIG. 19, even where either of the cartridges 10*a*, 10*b* is mounted on the cartridge mount 8, the second optical sensor 235 outputs the light-receiving signal having the same waveform. That is, when the second detected portion 186 enters into the area 236 of the second optical sensor 235, and thus the light is shielded, the signal level is changed from the LOW level to the HIGH level at time T1, and then, this state is maintained until the cartridge 10*a* or 10*b* is fully mounted. It is noted that, in the controller 200, the change, from the LOW level to the HIGH level, of the signal level of the light-receiving signal outputted from the second optical sensor 235 serves as a trigger signal for starting a judging process (shown in FIG. 20) described below.

On the other hand, the waveform of the light-receiving signal outputted from the first optical sensor 230 in a case where the cartridge 10*a* is mounted on the cartridge mount 8 is different from that in a case where the cartridge 10*b* is mounted on the cartridge mount 8.

Initially speaking, where the cartridge 10*a* is mounted on the cartridge mount 8, the bridge portion 189 enters into the area 231 and shields the light (at time T0 in the chart (b)) in the mounting process of the cartridge 10*a*. In this time, the signal level of the signal outputted from the first optical sensor 230 is changed from the LOW level to the HIGH level. However, the bridge portion 189 shields the light for a relatively short time because of being formed of a flat-plate-like member, and thus the bridge portion 189 is moved out from the area 231 at least until time T1 is reached in this image recording apparatus 1. Then, at the time T1, the clearance 190 (as shown in FIG. 3) is in the area 231. Thus, as shown in the chart (b), at the time T1, the signal level of the signal outputted from the first optical sensor 230 has been returned from the HIGH level to the LOW level.

Thereafter, when the cartridge 10*a* is further inserted into the back portion of the cartridge mount 8, the cutout portion 187 enters into the area 231. Then, when the cartridge 10*a* has been fully mounted on the cartridge mount 8 (in a state shown in FIG. 17), the cutout portion 187 and the detecting window 140 are in the area 231 (with reference to time T3 in the chart (b). In this state, that is, at the time T3, the movement of the indicator portion 72 which enters into and retracts from the detecting window 140 can be detected. It is noted that, in the chart (b), the signal level is shown by a solid line (the HIGH level) in a case where the indicator portion 72 is in the area 231 and shields the light, while the signal level is shown by a broken line (the LOW level) in a case where the indicator portion 72 is out of the area 231.

On the other hand, when the cartridge 10*b* is mounted on the cartridge mount 8, the bridge portion 189 enters into the area 231 and shields the light (at the time T0 in the chart (b)) in the mounting process of the cartridge 10*a*. In this time, the signal level of the signal outputted from the first optical sensor 230 is changed from the LOW level to the HIGH level. Here, in the case of the cartridge 10*b*, since the bridge portion 199 has the side walls 198, time for shielding the light is longer than that of the bridge portion 189 of the cartridge 10*a*. In this image recording apparatus 1, even when the time T1 has been reached with the time T0 passed, the side walls 198 is maintained to be in the area 231. Thus, as shown in the chart (b), even at the time T1, the signal level of the signal outputted from the first optical sensor 230 is maintained to be the HIGH level.

Thereafter, when the cartridge 10*b* is further inserted into the back portion of the cartridge mount 8, at the time T2, the side walls 198 is out of the area 231, and the cutout portion 187 enters into the area 231 instead. In this time, the signal level of the signal outputted from the first optical sensor 230 is returned from the HIGH level to the LOW level. Then, when the cartridge 10*b* has been fully mounted on the cartridge mount 8, the cutout portion 187 and the detecting window 140 are in the area 231 (with reference to time T3 in the chart (d)). In this state, that is, at the time T3, the movement of the indicator portion 72 which enters into and retracts from the detecting window 140 can be detected. It is noted that, in the chart (d), the signal level is shown by a solid line (the HIGH level) in a case where the indicator portion 72 is in the area 231 and shields the light, while the signal level is shown by a broken line (the LOW level) in a case where the indicator portion 72 is out of the area 231.

As thus described, the cartridges 10*a*, 10*b* are different from each other in whether the signal level of the light-receiving signal outputted from the first optical sensor 230 is returned from the HIGH level to the LOW level before or after the time T1 at which the light-receiving signal outputted from the second optical sensor 235 is changed from the LOW level to the HIGH level.

Judgment of Type of Cartridge

Figure 20:
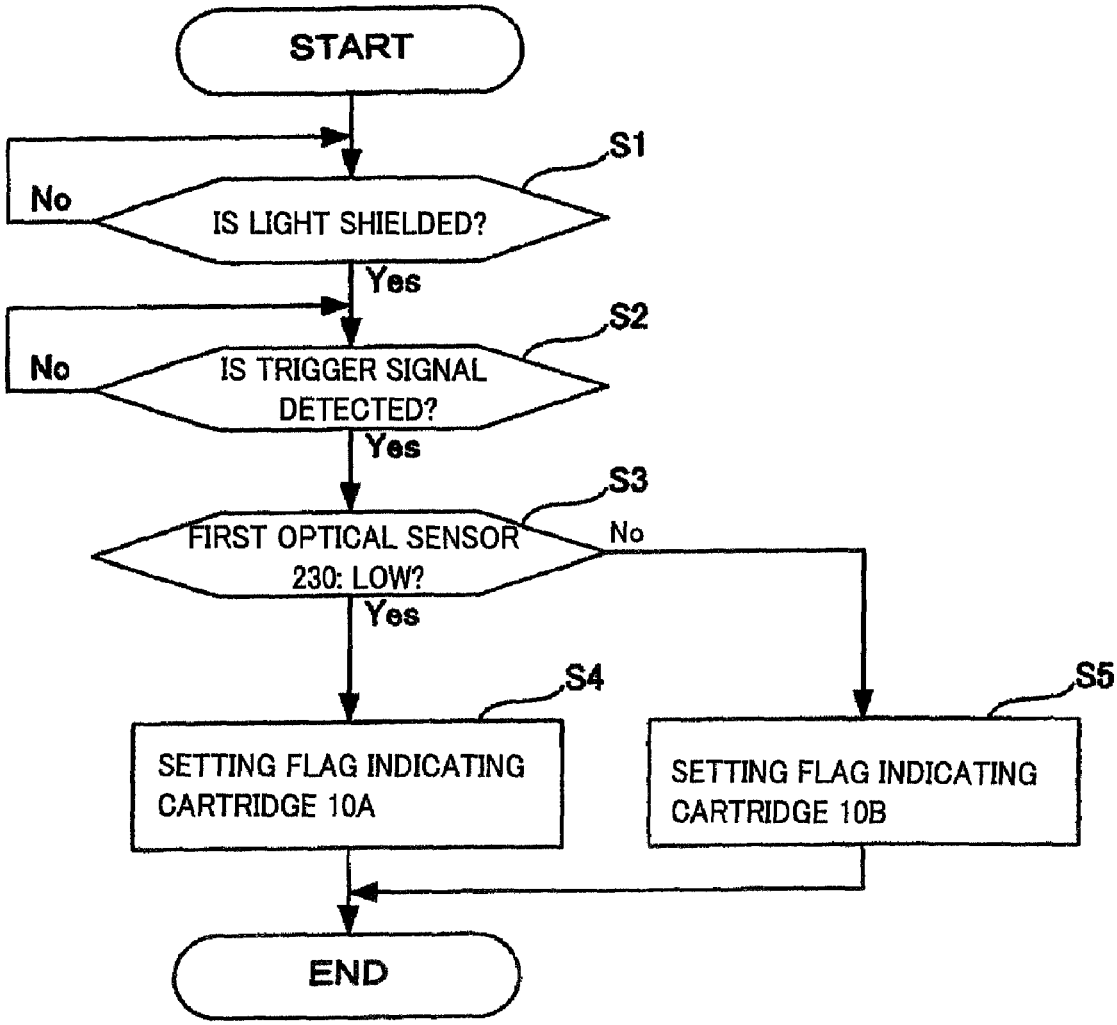
FIG. 20 is a flow-chart showing an example of a procedure of a cartridge-type judging process performed by the controller.

In this image recording apparatus 1, the type of the cartridge 10 which is in the state of being mounted on the cartridge mount 8 can be judged on the basis of the light-receiving signals outputted from the first optical sensor 230 and the second optical sensor 235. FIG. 20 is a flow-chart showing an example of a procedure of the cartridge-type judging process performed by the controller 200. Hereinafter, there will be explained, with reference to FIG. 20, the procedure of the process in which the type of the cartridge 10 is judged.

Initially, in S1, the controller 200 judges whether the light is shielded at the area 231 of the first optical sensor 230. Specifically, the controller 200 judges in S1 on the basis of whether the signal level of the signal outputted from the first optical sensor 230 is changed from the LOW level to the HIGH level or not (with reference to the charts (b), (d) in FIG. 19). Here, the controller 200 has judged that the light is shielded at the area 231 (S1: Yes), the processing goes to S2. It is noted that, in this image recording apparatus 1, as long as the controller 200 has judged, in S1, that the light is shielded at the area 231, the cartridge-type judging process of the cartridge 10 is not performed.

Next, in S2, the controller 200 judges whether the above-described trigger signal is present or absent. That is, the controller 200 judges whether the signal level of the signal outputted from the second optical sensor 235 is changed from the LOW level to the HIGH level or not. Where the trigger signal is detected in S2, the controller 200 judges, in S3, whether the signal level of the signal outputted from the first optical sensor 230 is the LOW level or the HIGH level at a timing (i.e., at the time T1 in FIG. 19) at which the trigger signal is detected. For example, with reference to FIG. 19, where the signal level is the LOW level at the time T1, the controller 200 judges that the cartridge 10*a* is in the state of being mounted on the cartridge mount 8. Further, where the signal level is the HIGH level at the time T1, the controller 200 judges that the cartridge 10*b* is in the state of being mounted on the cartridge mount 8.

In S3, where the controller 200 has judged that the signal level of the signal outputted from the first optical sensor 230 is the LOW level, a bit flag indicating the cartridge 10*a* is set to a register of the processor 201 and the like. On the other hand, the controller 200 has judged in S3 that the signal level of the signal outputted from the first optical sensor 230 is the HIGH level, a bit flag indicating the cartridge 10*b* is set to the register of the processor 201 and the like. It is noted that the set bit flag is inputted to an information processing device (a personal computer) connected to the image recording apparatus 1 through network, the liquid crystal display 11*a* of the image recording apparatus 1, and so on.

As thus described, in this image recording apparatus 1, when the trigger signal is detected in the mounting process of the cartridge 10, the type of the cartridge 10 is judged on the basis of the timing at which the signal levels of the signals outputted from the first optical sensor 230 and the second optical sensor 235 are changed. Thus, regardless of an operation speed of the user for mounting the cartridge 10 on the cartridge mount 8, the type of the cartridge 10 can be judged certainly and accurately.

Intermittent Control of Optical Sensors

Meanwhile, where the judgment of the type of the cartridges 10 is performed, in this image recording apparatus 1, the first optical sensor 230 and the second optical sensor 235 are started to operate from a timing at which the controller 200 has detected, through the opening and closing sensor 228, that the lock lever 220 of the cartridge mount 8 is opened. That is, the first optical sensor 230 and the second optical sensor 235 are started to operate from a timing at which the detection of the information about the cartridge 10 becomes to be allowed. In this time, the first optical sensor 230 operates in a "constant operational mode" in which the first optical sensor 230 is in a constant active state that whether the cartridge 10 is in the state of being mounted or removed (a specific information) and information of the remaining amount of the ink can be constantly detected. In this image recording apparatus 1, where the controller 200 has judged that the first optical sensor 230 is continued to operate in the constant operational mode until a predetermined time has passed from the timing at which the detection of the information about the cartridge 10 becomes to be allowed, the first optical sensor 230 is started to operate in an "intermittent operational mode" in which only whether the cartridges 10 is in the state of being mounted or removed (the specific information) can be intermittently detected. This restrains deterioration of the first optical sensor 230, and in particular, restrains deterioration of the light-emitting element 233 of the first optical sensor 230.

Hereinafter, there will be explained examples in which the controller 200 controls the first optical sensor 230 to operate in the intermittent operational mode. It is noted that, in these examples, the cartridge information detecting device 300 (shown in FIG. 18) of the controller 200 controls the first optical sensor 230 to operate. Further, needless to say, in the constant operational mode, the first optical sensor 230 may be consecutively energized, and additionally, the first optical sensor 230 may be intermittently energized in normal mounting of the cartridge 10 by the user as long as the first optical sensor 230 is intermittently energized in a degree that the processing (in particular, the judgment of the signal level of the signal outputted from the first optical sensor 230 at the time T1) shown in FIG. 20 can be accurately performed. Further, when the opening of the lock lever 220 is detected through the opening and closing sensor 228, the five first optical sensors 230 and the five second optical sensors 235 provided for respective five cartridges are operating (that is, the light-emitting element takes an "ON" state).

Figure 21A:
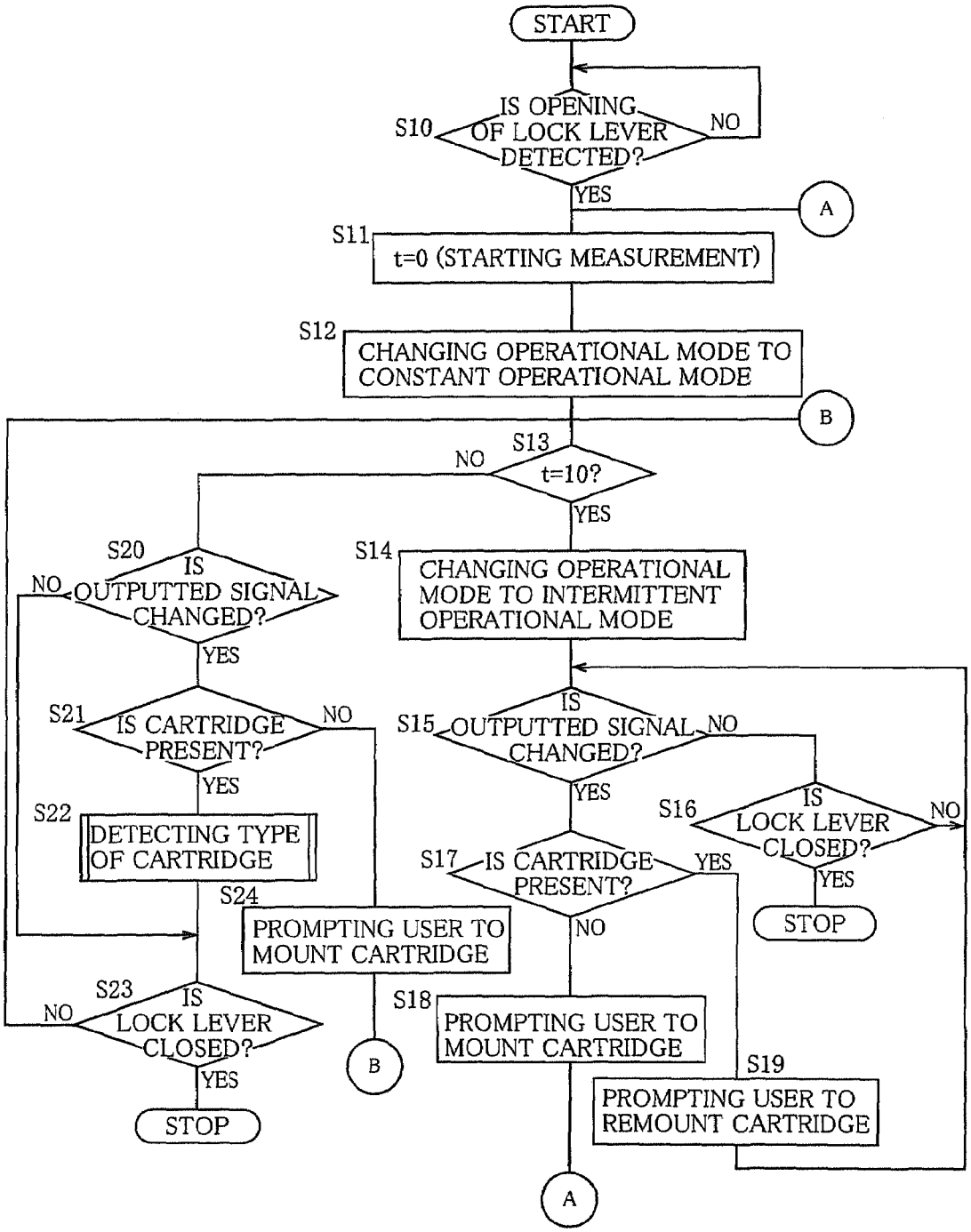
FIGS. 21A and 21B are each a flow-chart showing an example of a procedure where the first optical sensor is controlled by the controller in an intermittent operational mode.
Figure 21B:
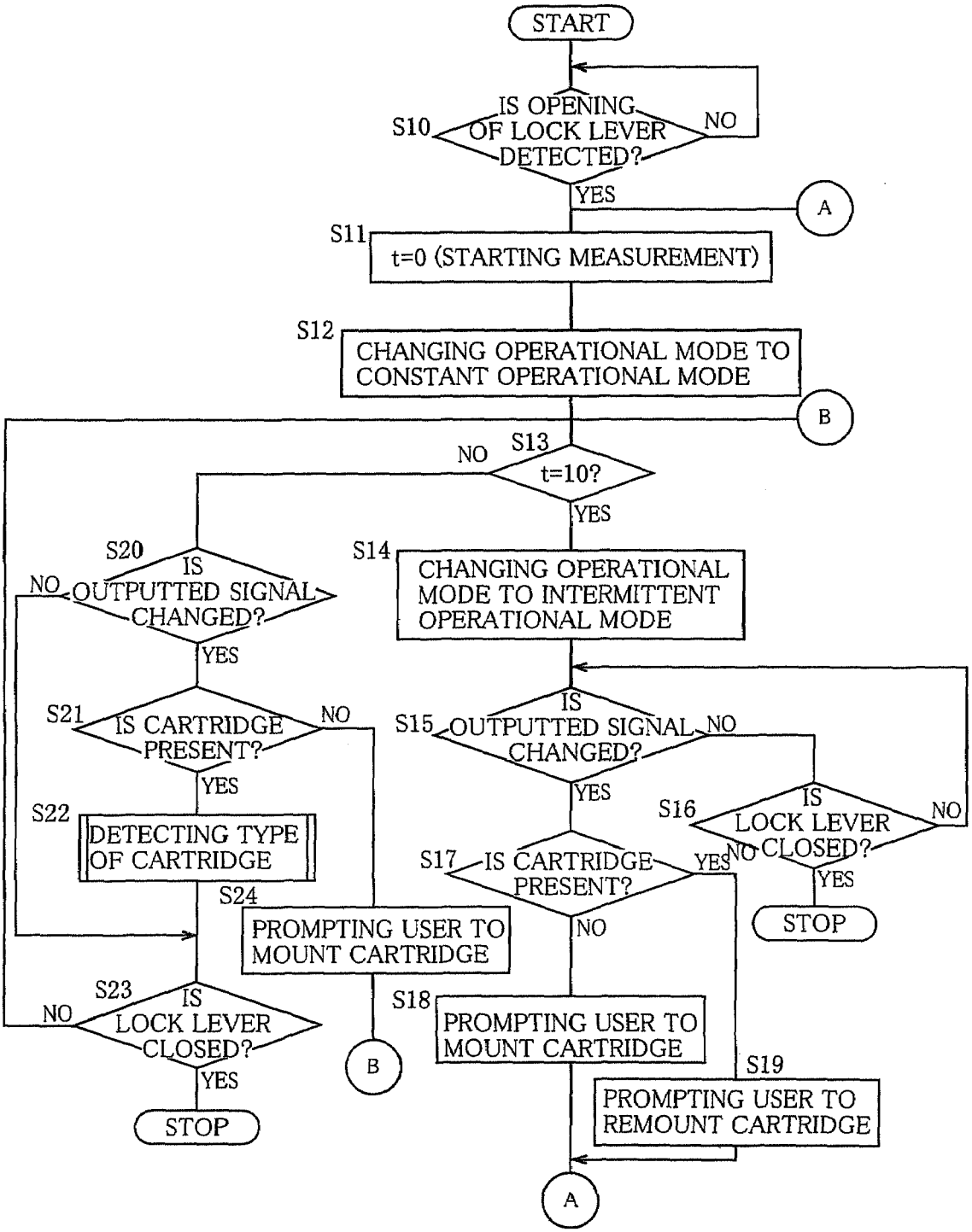
Figure 22:
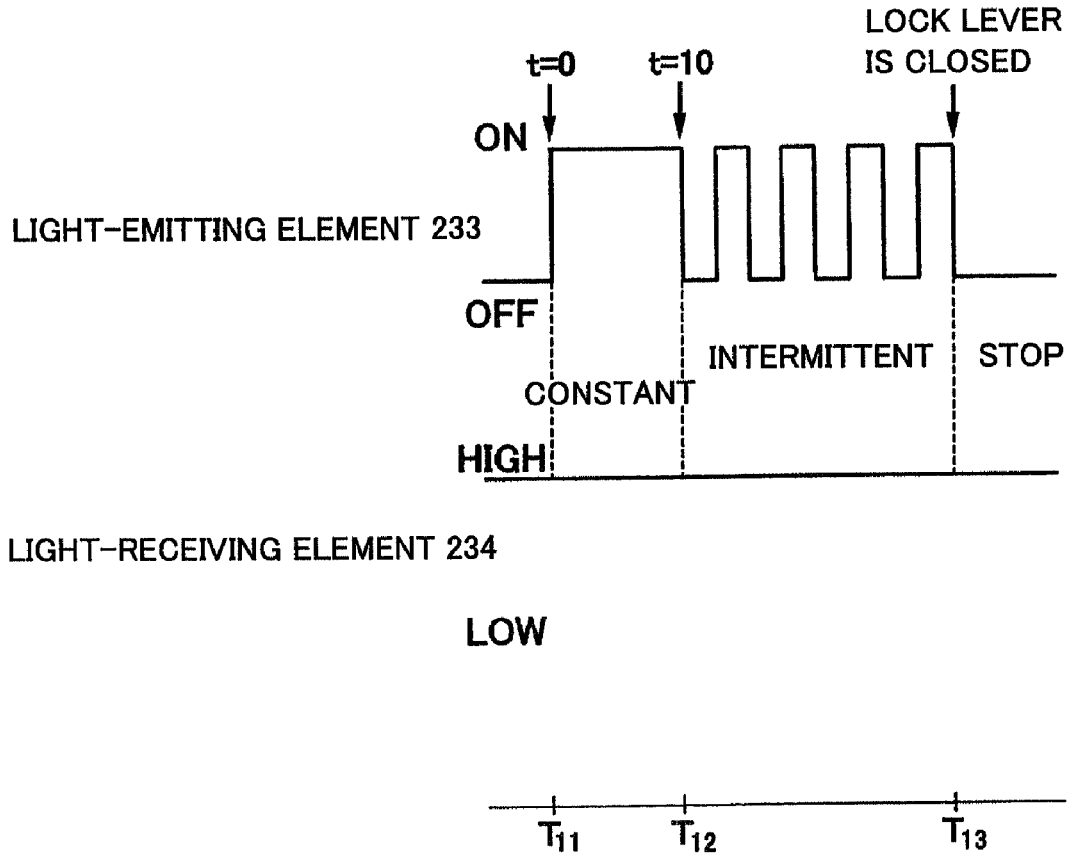
FIG. 22 is a timing chart showing an example (a first embodiment) of an operation of the first optical sensor controlled according to the flow-chart shown in FIG. 21A.

Each of FIGS. 21A and 21B is a flow-chart showing a procedure where the first optical sensor 230 is controlled by the controller 200 in the intermittent operational mode. FIG. 22 is a timing chart showing an example of an operation of the first optical sensor 230 controlled according to the flow-chart shown in FIG. 21A. Each of FIGS. 23, 25, 26, 27 is a timing chart showing an example of another operation of the first optical sensor 230 controlled according to the flow-chart shown in FIG. 21A. FIG. 24 is a timing chart showing an example of another operation of the first optical sensor 230 controlled according to the flow-chart shown in FIG. 21B.

FIRST EXAMPLE

Initially, there will be explained an example in which the controller 200 controls the first optical sensor 230 to operate in the intermittent operational mode, with reference to the flow-chart shown in FIG. 21A and the timing chart shown in FIG. 22. Here, there will be explained a case in which an operational mode of the first optical sensor 230 is changed to the intermittent operational mode when the cartridge 10 is not removed in the predetermined time after the first optical sensor 230 operates or takes an "ON" state by the opening of the lock lever 220 and is started to operate in the constant operational mode.

As shown in FIG. 21A, where the opening of the lock lever 220 is detected, in S10, through the opening and closing sensor 228, that is, detection of the information about the cartridge is allowed, the controller 200 functioning as a timer which measures time resets, in S11, a measured time t to zero (t=0) and starts a measurement of a passed time. At the same time, the controller 200 controls, in S12, the first optical sensor 230 and the second optical sensor 235 to operate in the constant operational mode (at a time $T_{11}$ shown in FIG. 22). In this time, since the cartridge 10 is not removed in this first example, the signal level of the first optical sensor 230 is the HIGH level (with reference to FIG. 22).

Thereafter, the controller 200 judges in S13, whether the predetermined time has been passed or not. For example, the controller 200 judges in S13 whether the measured time t has reached 10 minutes (t=10) or not. Where the controller 200 has judged that the predetermined time has passed (S13: Yes), the controller 200 permits, in S14, the first optical sensor 230 to operate in the intermittent operational mode by changing the operational mode of the first optical sensor 230 from the constant operational mode to the intermittent operational mode (at a time $T_{12}$ shown in FIG. 22). During the operation of the first optical sensor 230 in the intermittent operational mode, the controller 200 judges in S15 whether the signal outputted from the first optical sensor 230 has changed or not. That is, the controller 200 judges whether the signal level has changed from the HIGH level to the LOW level by the removing of the cartridge 10 or not. Where the signal level is not changed from the HIGH level to the LOW level (S15: No), the controller 200 judges whether the lock lever 220 is closed or not (S16). Where the controller 200 has judged that the lock lever 220 has been closed (S16: Yes), the first optical sensor 230 is stopped to operate (at a time $T_{13}$ shown in FIG. 22).

By performing these operations, when the predetermined time (t=10) has passed from the timing at which the lock lever 220 is opened, the operational mode of the first optical sensor 230 is changed from the constant operational mode to the intermittent operational mode, whereby the first optical sensor 230 can operate in the intermittent operational mode. Thus, the deterioration of the first optical sensor 230 can be restrained. It is noted that where the controller 200 has judged that the lock lever 220 has been closed before the predetermined time (t=10) has not been passed in S13 (S20: No and S23: Yes), the first optical sensor 230 may be stopped to operate at this time. Further, in this example and examples which will be explained below, during the operation of the first optical sensor 230 in the intermittent operational mode, the second optical sensor 235 may operate in the constant operational mode. In this case, the deterioration of the first optical sensor 230 can be restrained. Instead of this case, during the operation of the first optical sensor 230 in the intermittent operational mode, the second optical sensor 235 may operate in the intermittent operational mode or be stopped (that is, the second optical sensor 235 is in an inactive mode in which the detection of the information about the cartridge is not allowed). Where the second optical sensor 235 thus operates in the intermittent operational mode or is stopped, the deterioration of not only the first optical sensor 230 but also the second optical sensor 235 can be restrained while the specific information can be detected, after the predetermined time has passed. An explanation of this is omitted because the second optical sensor 235 and the first optical sensor 230 have the same construction.

SECOND EXAMPLE

Figure 23:
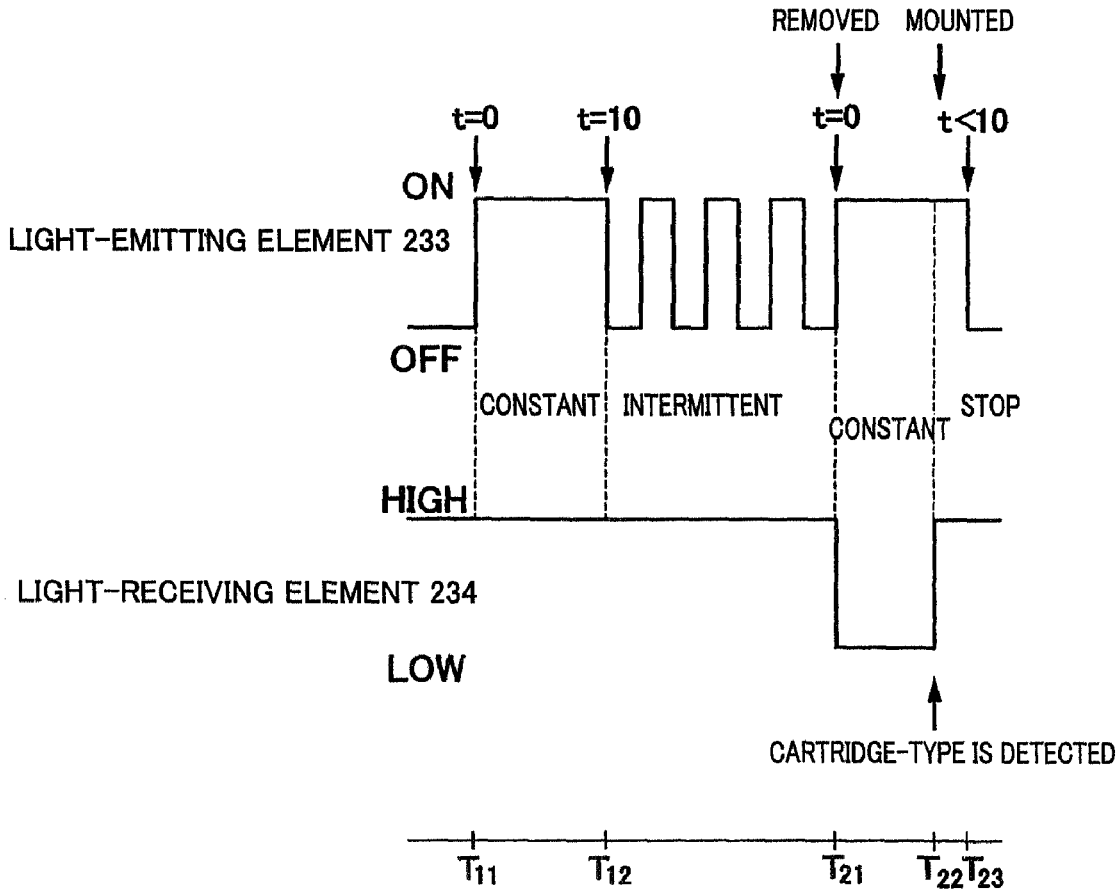
FIG. 23 is a timing chart showing an example (a second embodiment) of another operation of the first optical sensor controlled according to the flow-chart shown in FIG. 21A.
Figure 24:
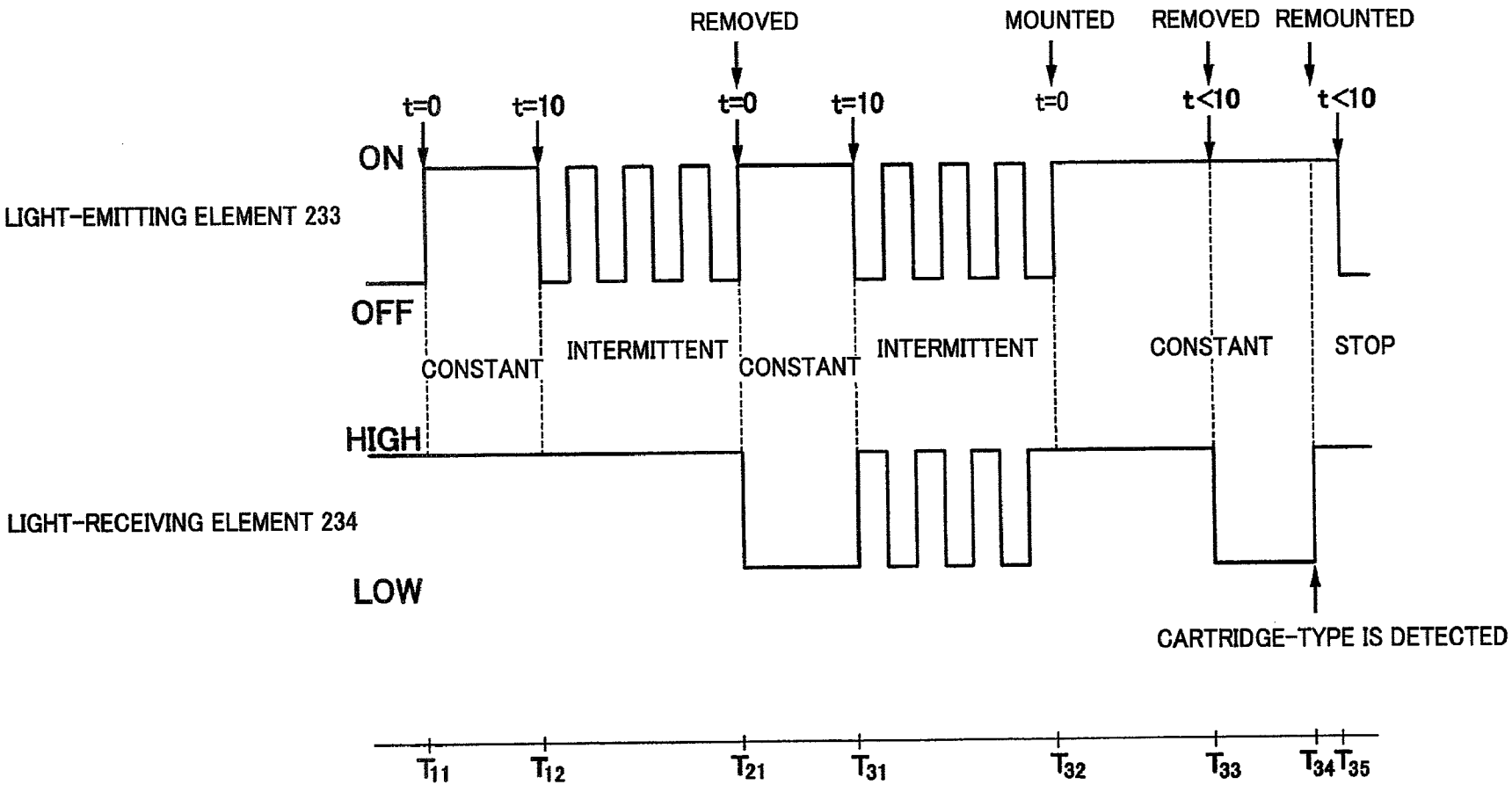
FIG. 24 is a timing chart showing an example (a third embodiment) of another operation of the first optical sensor controlled according to the flow-chart shown in FIG. 21B.

Next, there will be next explained another example in which the controller 200 controls the first optical sensor 230 to operate in the intermittent operational mode, with reference to the flow-chart shown in FIG. 21A and the timing chart shown in FIG. 23. Here, there will be explained a case in which the cartridge 10 is removed and a new cartridge 10 is mounted on the cartridge mount 8 during the operation of the first optical sensor 230 in the intermittent operational mode.

As shown in FIG. 23, the first optical sensor 230 operates like in the first example until the time $T_{12}$, and the first optical sensor 230 is started to operate in S14 in the intermittent operational mode instead of the constant operational mode at the time $T_{12}$. During the operation of the first optical sensor 230 in the intermittent operational mode, the controller 200 judges in S15 whether the signal level of the signal outputted from the first optical sensor 230 is changed or not. That is, in this example, the controller 200 judges whether the signal level is changed from the HIGH level to the LOW level by the removing of the cartridge 10 or not. Then, where the controller 200 has judged that the signal level is thus changed at a time $T_{21}$ in FIG. 23 (S15: Yes), the controller 200 confirms, in S17, presence and absence of the cartridge 10 on the basis of the signal level. Where the controller 200 has judged that the cartridge 10 is removed (S17: No), the controller 200 controls the liquid crystal display 11*a* such that information for prompting the user to mount the cartridge 10 on the cartridge mount 8 is displayed, in S18, on the liquid crystal display 11*a*. Then, the processing returns to S11 and S12, that is, the controller 200 resets the measured time t (t=0) and starts to measure again from the time $T_{21}$ in S11, and the controller 200 permits the first optical sensor 230 to operate in the constant mode by changing the operational mode thereof from the intermittent operational mode to the constant operational mode in S12.

Thereafter, where the measured time t has not reached 10 minutes (t=10), the processing goes to S20. In S20, the controller 200 judges whether the signal level of the signal outputted from the first optical sensor 230 is changed or not. Where the controller 200 has judged that the signal level is changed (S20: Yes), the controller 200 confirms, in S21, the presence and absence of the cartridge 10 on the basis of the signal level. Where the controller 200 has confirmed the presence of the cartridge 10 on the basis of the signal level (S21: Yes), that is, the new cartridge 10 is mounted, as shown in FIG. 23, on the cartridge mount 8 at a time $T_{22}$ at which the time passed from the time $T_{21}$ has not reached 10 minutes (t=10), the controller 200 detects in S22, through the first optical sensor 230 and the second optical sensor 235 operating in the constant operational mode, the information about the cartridge 10, e.g., the type of the cartridge 10 (another information). This detection is performed according to the procedure explained using FIGS. 19 and 20. Then, the lock lever 220 is closed at the time $T_{23}$ after the detection of the information about the cartridge 10 and before the passed time has reached 10 minutes (a specific time) (S23: Yes). Then, the first optical sensor 230 and the second optical sensor 235 are stopped to operate. It is noted that where the controller 200 has judged that the signal level is not changed (S20: No), the processing goes to S23. Where the controller 200 has confirmed, in S21, the absence of the cartridge 10 on the basis of the signal level, the controller 200 controls the liquid crystal display 11*a*, in S24, such that the information for prompting the user to mount the cartridge 10 on the cartridge mount 8 is displayed on the liquid crystal display 11*a*, and then the processing returns to S13.

By performing these operations, when the predetermined time has passed from the opening of the lock lever 220, the controller 200 permits the first optical sensor 230 to operate by changing the operational mode thereof from the constant operational mode to the intermittent operational mode, whereby the deterioration of the first optical sensor 230 can be restrained. Further, even in this case in which the cartridge 10 is removed and the new cartridge 10 is mounted on the cartridge mount 8 during the operation of the first optical sensor 230 in the intermittent operational mode, the first optical sensor 230 and the second optical sensor 235 operate in the constant operational mode when the new cartridge 10 is mounted on the cartridge mount 8, whereby the information about the cartridge 10 (i.e, the another information) can be properly detected.

THIRD EXAMPLE

Next, there will be next explained another example in which the controller 200 controls the first optical sensor 230 to operate in the intermittent operational mode, with reference to the flow-chart shown in FIG. 21B and the timing chart shown in FIG. 24. Here, there will be explained a case in which the cartridge 10 is removed during the operation of the first optical sensor 230 in the intermittent operational mode and a new cartridge 10 is mounted on the cartridge mount 8 after a relatively long time has passed in a state in which the cartridge 10 is in the state of being removed.

As shown in FIG. 24, the first optical sensor 230 operates like in the second example until the time $T_{21}$. From the time $T_{21}$, the first optical sensor 230 operates in S12 in the constant operational mode in the state in which the cartridge 10 is in the state of being removed. Thereafter, where the time passed from the time $T_{21}$ has reached 10 minutes (t=10, the specific time) in the state in which the cartridge 10 is in the state of being removed (S13: Yes), the controller 200 controls in S14 the first optical sensor 230 again to operate in the intermittent operational mode by changing the operational mode of the first optical sensor 230 from the constant operational mode to the intermittent operational mode at a time $T_{31}$ in FIG. 24. Subsequently, when the new cartridge 10 is mounted on the cartridge mount 8 in a state in which the first optical sensor 230 operates in the intermittent operational mode at a time $T_{32}$ in FIG. 24, the change of the signal level outputted from the first optical sensor 230 is detected (S15: Yes). Then, the controller 200 confirms, in S17, the presence and absence of the cartridge 10 on the basis of the signal level. Here, the controller 200 has confirmed that the cartridge 10 is in the state of being mounted on the cartridge mount 8 on the basis that the signal level of the signal outputted from the first optical sensor 230 is changed to the HIGH level (S17: Yes).

Thereafter, in S19, the controller 200 controls the liquid crystal display 11*a* such that information for prompting the user to remount the cartridge 10 on the cartridge mount 8 is displayed on the liquid crystal display 11*a*. More specifically, on the liquid crystal display 11*a* is displayed the information for prompting the user to temporarily remove the cartridge 10 from the cartridge mount 8 and then mount the cartridge 10 again on the cartridge mount 8. Then, the processing returns to S11 and S12. That is, in S11, the controller 200 resets the measured time t (t=0) and restarts the measurement from the time $T_{32}$. In S12, the controller 200 permits the first optical sensor 230 to operate in the constant operational mode again by changing the operational mode of the first optical sensor 230 from the intermittent operational mode to the constant operational mode.

Then, at a time $T_{33}$ at which the time passed from the time $T_{32}$ has not reached 10 minutes (t=10), the cartridge 10 is removed from the cartridge mount 8, and at a time $T_{34}$ at which the time passed from the time $T_{32}$ has not reached 10 minutes (t=10), the cartridge 10 is remounted on the cartridge mount 8. Thus, the controller 200 judges that the signal level of the signal outputted from the first optical sensor 230 is changed (S20: Yes).

Then, where the controller 200 has confirmed the presence of the cartridge 10 on the basis of the signal level (S21: Yes), the controller 200 detects in S22, through the first optical sensor 230 and the second optical sensor 235 operating in the constant operational mode, the type of the cartridge 10 (the another information). This detection is performed according to the procedure explained using FIGS. 19 and 20. Then, the lock lever 220 is closed at a time $T_{35}$ after the detection of the information about the cartridge 10 and before the passed time has reached 10 minutes (S23: Yes). Then, the first optical sensor 230 and the second optical sensor 235 are stopped to operate.

By performing these operations, in addition to after the predetermined time has passed from the opening of the lock lever 220, after the specific time has passed, in a state in which the old cartridge 10 is in the state of being removed, from the timing at which the old cartridge 10 is removed, the operational mode of the first optical sensor 230 is changed to the intermittent operational mode. Thus, the constant operational mode and the intermittent operational mode are flexibly changed to each other depending on whether the cartridge 10 is in the state of being mounted or removed, thereby restraining the deterioration of the first optical sensor 230. Further, where the first optical sensor 230 is operating in the intermittent mode in the state in which the cartridge 10 is in the state of being mounted, the operational mode of the first optical sensor 230 can be changed to the constant operational mode by the removal of the cartridge 10 as a trigger. Thus, when the new cartridge 10 is remounted on the cartridge mount 8 (at the time T33), the first optical sensor 230 and the second optical sensor 235 operate in the constant operational mode. Here, there is a possibility that information about the new cartridge 10 cannot be detected where the first optical sensor 230 and the second optical sensor 235 operate in the intermittent operational mode. However, in this image recording apparatus 1, since the first optical sensor 230 and the second optical sensor 235 operate in the constant operational mode, the information about the new cartridge 10 can be properly detected. It is noted that when the controller 200 has judged that the cartridge 10 is removed after the information for prompting the user to remount the cartridge 10 is displayed on the liquid crystal display 11*a*, the controller 200 may reset the measured time t to zero (t=0).

FOURTH EXAMPLE

Figure 25:
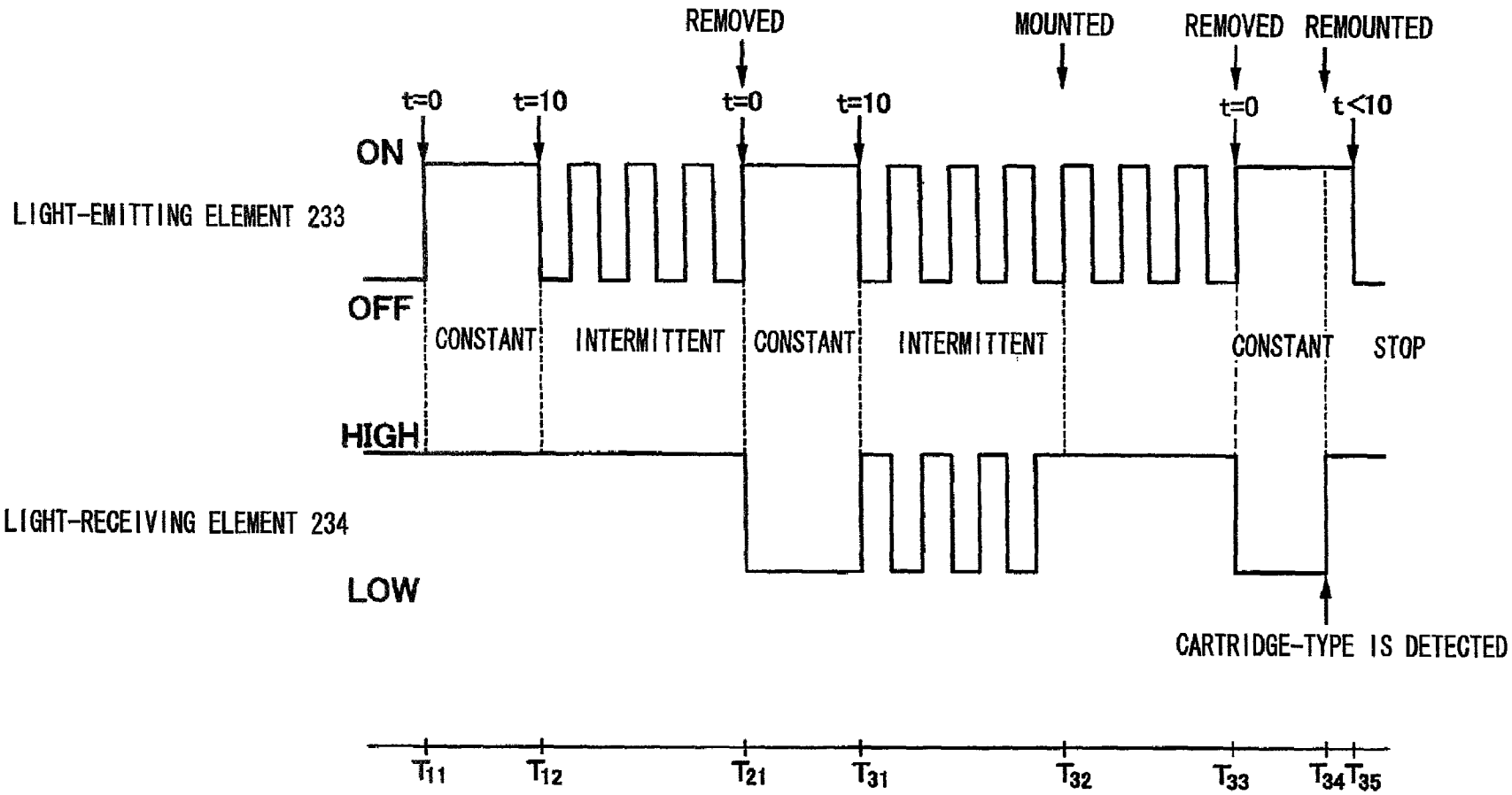
FIG. 25 is a timing chart showing an example (a fourth embodiment) of another operation of the first optical sensor controlled according to the flow-chart shown in FIG. 21A.

Next, there will be next explained another example in which the controller 200 controls the first optical sensor 230 to operate in the intermittent operational mode, with reference to the flow-chart shown in FIG. 21A and the timing chart shown in FIG. 25. Here, there will be explained another case in which the cartridge 10 is removed, like in the third example, during the operation of the first optical sensor 230 in the intermittent operational mode and a new cartridge 10 is mounted on the cartridge mount 8 after a relatively long time has passed in a state in which the cartridge 10 is in the state of being removed.

As shown in FIG. 25, the first optical sensor 230 operates like in the third example until the time $T_{32}$. Since the time passed from the time $T_{21}$ has reached 10 minutes (t=10) in the state in which the cartridge 10 is in the state of being removed, the first optical sensor 230 operates in 814 in the intermittent operational mode at the time $T_{31}$ in FIG. 25. Then, where the new cartridge 10 is mounted on the cartridge mount 8 in the intermittent operational mode at the time $T_{32}$ in FIG. 25, the change of the signal level of the signal outputted from the first optical sensor 230 is detected (S15: Yes). Thus, the controller 200 confirms, in S17, the presence and absence of the cartridge 10 on the basis of the signal level. Here, the controller 200 has confirmed that the cartridge 10 is in the state of being mounted on the cartridge mount 8 on the basis that the signal level of the signal outputted from the first optical sensor 230 is changed to the HIGH level (S17: Yes).

Then, in S19, the controller 200 controls the liquid crystal display 11*a* such that information for prompting the user to remount the cartridge 10 on the cartridge mount 8 is displayed on the liquid crystal display 11*a* in order to properly detect the information of the cartridge 10. Thereafter, where the cartridge 10 is removed from the cartridge mount 8 at the time $T_{33}$, the controller 200 has judged, in S15, that the signal level of the signal outputted from the first optical sensor 230 is changed (S15: Yes). Then, in S17, the controller 200 has confirmed that the cartridge 10 is in the state of being removed from the cartridge mount 8 (S17: No). Then, in S18, the controller 200 controls the liquid crystal display 11*a* such that the information for prompting the user to mount the cartridge 10 on the cartridge mount 8 is displayed on the liquid crystal display 11*a*. Then, the processing returns to S11 and S12, that is, the controller 200 resets the measured time t (t=0) and starts to measure again from the time $T_{33}$ in S11, and the controller 200 permits the first optical sensor 230 to operate in the constant mode by changing the operational mode thereof from the intermittent operational mode to the constant operational mode in S12.

Then, at the time $T_{34}$ at which the time passed from the time $T_{33}$ has not reached 10 minutes (t=10), the cartridge 10 is remounted on the cartridge mount 8. Thus, the controller 200 has judged that the signal level of the signal outputted from the first optical sensor 230 is changed (S20: Yes). Then, where the controller 200 has confirmed the presence of the cartridge 10 on the basis of the signal level (S21: Yes), the controller 200 detects in S22, through the first optical sensor 230 and the second optical sensor 235 operating in the constant operational mode, the type of the cartridge 10 (the another information). This detection is performed according to the procedure explained using FIGS. 19 and 20. Then, the lock lever 220 is closed at the time $T_{35}$ after the detection of the information about the cartridge 10 and before the passed time has reached 10 minutes (S23: Yes). Then, the first optical sensor 230 and the second optical sensor 235 are stopped to operate.

By performing these operations, the effects obtained in the third example can be obtained. In addition, the first optical sensor 230 operates in the intermittent operational mode when the new cartridge 10 is in the state of being mounted on the cartridge mount 8. Thus, even where the cartridge 10 is left unremoved in spite that the information for prompting the user to remount the cartridge 10 on the cartridge mount 8 is displayed on the liquid crystal display 11*a*, the first optical sensor 230 is continued to operate in the intermittent operational mode until the time $T_{33}$ at which the cartridge 10 is removed, thereby restraining the deterioration of the first optical sensor 230.

FIFTH EXAMPLE

Figure 26:
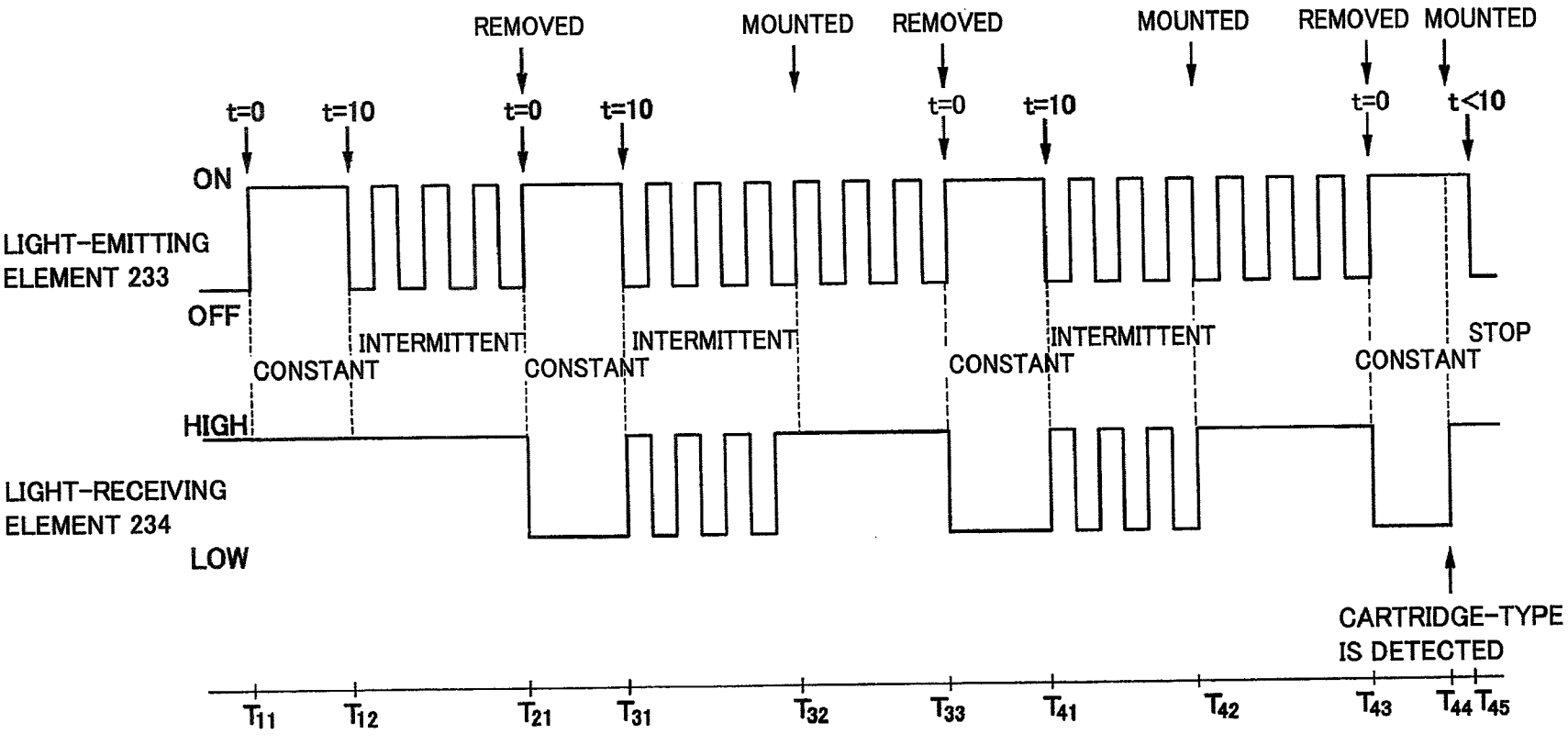
FIG. 26 is a timing chart showing an example (a fifth embodiment) of another operation of the first optical sensor controlled according to the flow-chart shown in FIG. 21A.

Next, there will be next explained another example in which the controller 200 controls the first optical sensor 230 to operate in the intermittent operational mode, with reference to the flow-chart shown in FIG. 21A and the timing chart shown in FIG. 26. Here, there will be explained a case in which after the cartridge 10 is removed at the time $T_{33}$ in response to the information for prompting the user to remount the cartridge 10 in the above-described fourth example, the cartridge 10 is remounted on the cartridge mount 8 after a relatively long time has been passed from the time $T_{33}$.

As shown in FIG. 26, the first optical sensor 230 operates like in the fourth example until the time $T_{33}$. From the time $T_{33}$, the controller 200 resets the measured time t (t=0) and starts to measure again from the time $T_{33}$ in S11, and the first optical sensor 230 operates in S12 in the constant operational mode in the state in which the cartridge 10 is in the state of being removed. Thereafter, the time has reached 10 minutes (t=10) without the remount of the cartridge 10 at a time $T_{41}$ in FIG. 26 (S13: Yes), the operational mode of the first optical sensor 230 is changed in S14 from the constant operational mode to the intermittent operational mode. Next, where the cartridge 10 is remounted on the cartridge mount 8 in the intermittent operational mode at a time $T_{42}$ in FIG. 26, the controller 200 judges in S15 whether the signal level outputted from the first optical sensor 230 is changed or not. In this fifth example, the controller 200 has judged that the signal level outputted from the first optical sensor 230 is changed (S15: Yes), and thus the controller 200 confirms, in S17, the presence and absence of the cartridge 10 on the basis of the signal level. Here, the controller 200 has confirmed that the cartridge 10 is in the state of being mounted on the cartridge mount 8 on the basis that the signal level of the signal outputted from the first optical sensor 230 is changed to the HIGH level (S17: Yes).

Thereafter, the processing is performed like the procedure performed after the time $T_{32}$ in the fourth example. That is, in S19, the controller 200 controls the liquid crystal display 11*a* such that information for prompting the user to remount the cartridge 10 on the cartridge mount 8 is displayed on the liquid crystal display 11*a* in order to properly detect the information of the cartridge 10. Thereafter, where the cartridge 10 is removed from the cartridge mount 8 at a time $T_{43}$, the controller 200 has judged, in S15, that the signal level outputted from the first optical sensor 230 is changed (S15: Yes). Then, in S17, the controller 200 has confirmed that the cartridge 10 is in the state of being removed from the cartridge mount 8 (S17: No). Then, in S18, the controller 200 controls the liquid crystal display 11*a* such that the information for prompting the user to mount the cartridge 10 on the cartridge mount 8 is displayed on the liquid crystal display 11*a*. Then, the processing returns to S11 and S12, that is, the controller 200 resets the measured time t (t=0) and starts to measure again from the time $T_{43}$ in S11, and the first optical sensor 230 operates in the constant operational mode again in S12.

Then, at a time $T_{44}$ at which the time passed from the time $T_{43}$ has not reached 10 minutes (t=10), the cartridge 10 is remounted on the cartridge mount 8. Thus, the controller 200 has judged that the signal level outputted from the first optical sensor 230 is changed (S20: Yes). Then, where the controller 200 has confirmed the presence of the cartridge 10 on the basis of the signal level (S21: Yes), the controller 200 detects in S22, through the first optical sensor 230 and the second optical sensor 235 operating in the constant operational mode, the type of the cartridge 10 (the another information). This detection is performed according to the procedure explained using FIGS. 19 and 20. Then, the lock lever 220 is closed at a time $T_{45}$ after the detection of the information about the cartridge 10 and before the passed time has reached 10 minutes (S23: Yes). Then, the first optical sensor 230 and the second optical sensor 235 are stopped to operate. It is noted that, in the procedure after the time $T_{42}$, the controller 200 may control the first optical sensor 230 to operate in the constant operational mode by changing the operational mode of the first optical sensor 230 from the intermittent operational mode to the constant operational mode, like the procedure after the time $T_{32}$ in the third example.

As thus described, the new cartridge 10 is mounted on the cartridge mount 8 in the state in which the first optical sensor 230 is in the intermittent operational mode, and the operational mode of the first optical sensor 230 is changed to the constant operational mode by the removal of the cartridge 10 according to the information for prompting the remount thereof In this fifth example, by performing the above-described procedure, even where a time longer than the specific time has passed from the removal of the cartridge 10, the deterioration of the first optical sensor 230 can be restrained by the change of the operational mode of the first optical sensor 230 to the intermittent operational mode again. Further, when the cartridge 10 is remounted on the cartridge mount 8 at the time $T_{44}$, the first optical sensor 230 and the second optical sensor 235 are operating in the constant operational mode, whereby the information about the cartridge 10 can be properly detected.

SIXTH EXAMPLE

Figure 27:
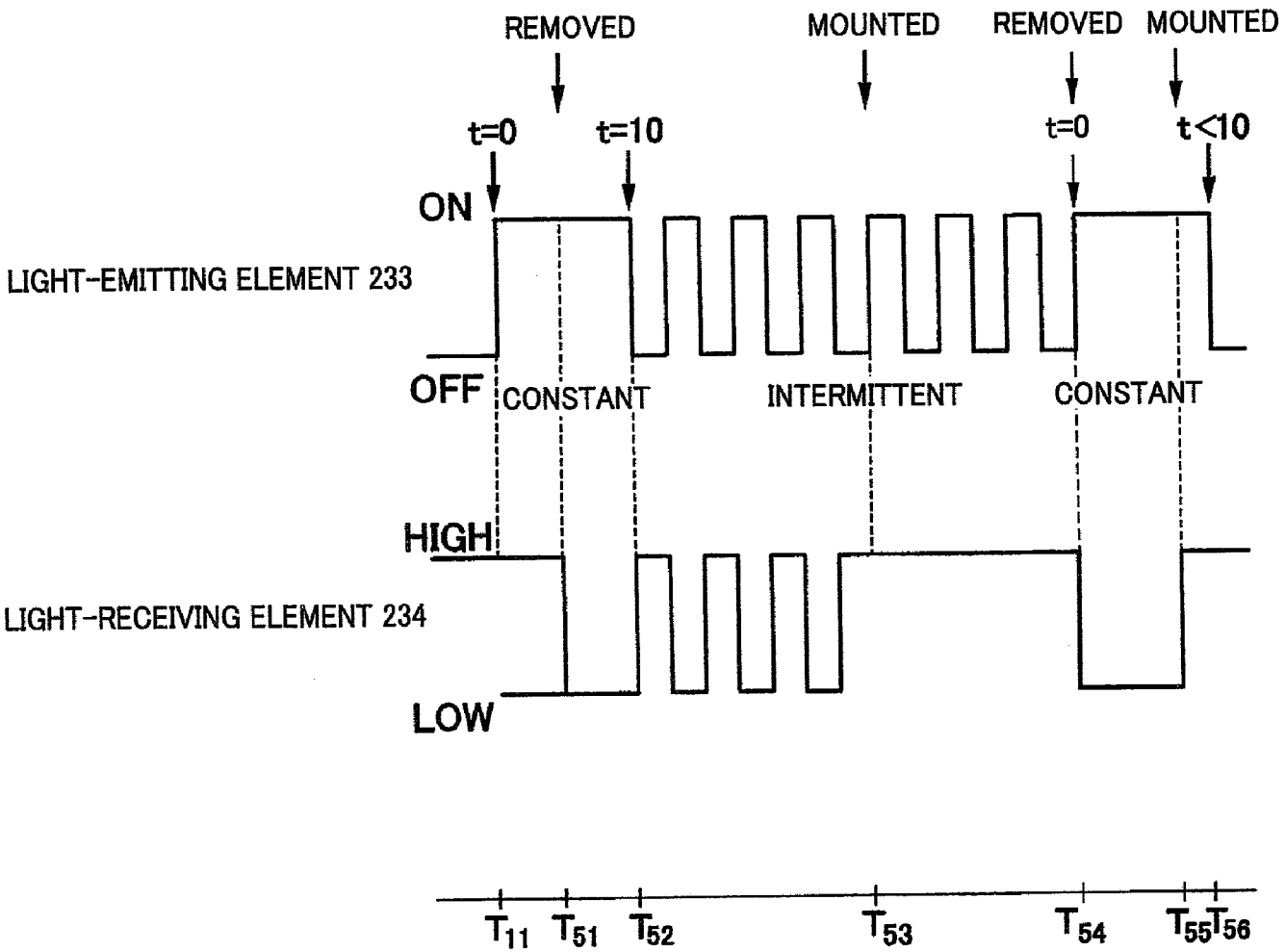
FIG. 27 is a timing chart showing an example (a sixth embodiment) of another operation of the first optical sensor controlled according to the flow-chart shown in FIG. 21A.

Next, there will be next explained another example in which the controller 200 controls the first optical sensor 230 to operate in the intermittent operational mode, with reference to the flow-chart shown in FIG. 21A and the timing chart shown in FIG. 27. Here, there will be explained a case in which after the lock lever 220 is initially opened, and the cartridge 10 is removed during the operation of the first optical sensor 230 in the constant operational mode, the mode of the first operational sensor 230 is changed to the intermittent operational mode before a new cartridge 10 is mounted on the cartridge mount 8.

As shown in FIG. 27, where the opening of the lock lever 280 has been detected in S10 through the opening and closing sensor 228, the controller 200 resets, in S11, the measured time t to zero (t=0), and starts to measure the time. At the same time, the controller 200 permit, in S12, the first optical sensor 230 and the second optical sensor 235 to operate in the constant operational mode at the time $T_{11}$ in FIG. 27. At this time, since the cartridge 10 is not in the state of being removed in this sixth example, the signal level outputted from the first optical sensor 230 is the HIGH level (with reference to FIG. 27).

Next, as shown in FIG. 27, where the cartridge 10 is removed at a time $T_{51}$ at which the first optical sensor 230 is operating in the constant operational mode, the signal level outputted from the first optical sensor 230 is changed from the HIGH level to the LOW level. Thereafter, where the time passed from the time T11 has reached 10 minutes (t=10) at a time $T_{52}$ (S13: Yes), the signal level outputted from the first optical sensor 230 is changed, in S14, from the constant operational mode to the intermittent operational mode. After the time $T_{52}$ at which the signal level is thus changed to the intermittent operational mode in the state in which the cartridge 10 is in the state of being removed, a procedure in this sixth example goes like the procedure after the time $T_{31}$ in the fourth example (with reference to FIG. 25).

That is, where the new cartridge 10 is mounted on the cartridge mount 8 at a time $T_{53}$ in FIG. 27 in the state in which the first optical sensor 230 is in the intermittent operational mode, the change of the signal level outputted from the first optical sensor 230 is detected (S15: Yes). Thus, the controller 200 has judged, on the basis of the signal level, that the cartridge 10 is in the state of being mounted on the cartridge mount 8 (S17: Yes), and the controller 200 further controls, in S19, the liquid crystal display 11*a* such that the information for prompting the user to remount the cartridge 10 on the cartridge mount 8 is displayed on the liquid crystal display 11*a*. Thereafter, where the cartridge 10 is removed from the cartridge mount 8 at a time $T_{54}$, the controller 200 has judged, in S15, that the signal level of the signal outputted from the first optical sensor 230 is changed (S15: Yes). Then, in S17, the controller 200 has confirmed that the cartridge 10 is in the state of being removed from the cartridge mount 8 (S17: No). Then, in S18, the controller 200 controls the liquid crystal display 11*a* such that the information for prompting the user to mount the cartridge 10 on the cartridge mount 8 is displayed on the liquid crystal display 11*a*. Then, the processing returns to S11 and S12, that is, the controller 200 resets the measured time t (t=0) and starts to measure again from the time $T_{54}$ in S11, and the first optical sensor 230 operates in the constant operational mode again in S12.

Then, at a time $T_{55}$ at which the time passed from the time $T_{54}$ has not reached 10 minutes (t=10), the cartridge 10 is remounted on the cartridge mount 8. Thus, the controller 200 has judged that the signal level outputted from the first optical sensor 230 is changed (S20: Yes). Then, where the controller 200 has confirmed the presence of the cartridge 10 on the basis of the signal level (S21: Yes), the controller 200 detects in S22, through the first optical sensor 230 and the second optical sensor 235 operating in the constant operational mode, the type of the cartridge 10 (the another information). This detection is performed according to the procedure explained using FIGS. 19 and 20. Then, the lock lever 220 is closed at a time $T_{56}$ after the detection of the information about the cartridge 10 and before the passed time has reached 10 minutes (S23: Yes). Then, the first optical sensor 230 and the second optical sensor 235 are stopped to operate. It is noted that, in the procedure after the time $T_{53}$, the controller 200 may control the first optical sensor 230 to operate in the constant operational mode by changing the operational mode of the first optical sensor 230 from the intermittent operational mode to the constant operational mode, like the procedure after the time $T_{32}$ in the third example.

As thus described, the lock lever 220 is opened, and the cartridge 10 is removed during the operation of the first optical sensor 230 in the constant operational mode. Then, the new cartridge 10 is mounted on the cartridge mount 8. In this sixth example, by performing the above-described procedure, even where the predetermined time has passed from the removal before the new cartridge 10 has been mounted on the cartridge mount 8, the deterioration of the first optical sensor 230 can be restrained by changing the operational mode of the first optical sensor 230 from the constant operational mode to the intermittent operational mode. Further, when the cartridge 10 is remounted on the cartridge mount 8 at the time $T_{55}$, the first optical sensor 230 and the second optical sensor 235 are operating in the constant operational mode, so that the information about the cartridge 10 can be properly detected.

As described above, in the cartridge information detecting device 300 of this image recording apparatus 1, the operational mode of the first optical sensor 230 and the second optical sensor 235 can be flexibly changed between the constant operational mode and the intermittent operational mode depending on whether the cartridge 10 is in the state of being mounted or removed. Thus, the deterioration of the first optical sensor 230 and the second optical sensor 235 caused by constant driving thereof for a relatively long time can be restrained.

As described above, during the operation of the first optical sensor 230 in the intermittent operational mode, the second optical sensor 235 may operate in the constant operational mode and in the intermittent operational mode, and may be stopped. That is, in the above-explained procedures, the controller 200 permits both of the first optical sensor 230 and the second optical sensor 235 to operate in the constant operational mode until the controller 200 has measured the specific time from the timing at which the specific information is detected through the first optical sensor 230, while the controller 200 permits only or at least the first optical sensor 230 to operate in the intermittent operational mode after the specific time has passed. Further, the controller 200 permits the first optical sensor 230 to operate in the intermittent operational mode and permits the second optical sensor 235 to be in a state in which the detection of the information about the cartridge is not allowed, after the specific time has passed. Thus, the deterioration of not only the first optical sensor 230 but also the second optical sensor 235 can be restrained while the specific information can be detected, after the specific time has passed.

It is noted that, in the explanation above, the timing at which the controller 200 has detected that the lock lever 220 is opened is employed as the timing at which the measured time t is initially started to be measured, but this image recording apparatus 1 is not limited to this configuration. For example, regardless of whether the lock lever 220 is opened or closed, the timing at which the first optical sensor 230 or the second optical sensor 235 is started to operate in the constant operational mode may be defined as the timing at which the measured time t is initially started to be measured. Further, regardless whether the lock lever 220 is opened or closed and whether the first optical sensor 230 and the second optical sensor 235 operate in the constant optical mode or in the intermittent optical mode, the measured time t may be started to be measured in synchronization with another timing. In short, it is sufficient that the measured time t can be started to be measured in a state in which the information about the cartridge 10 to be mounted on the cartridge mount 8 can be detected.

Further, in the explanation above, the lock lever 220 is the single covering member which covers the opening 9*b* of the accommodating casing 9, and the opening and closing sensor 228 is provided on the lock lever 220 such that the plurality of the sensors 230, 235 for the respective cartridges 10 operate at the same time on the basis of the movement of the opening and closing sensor 228. However, the image recording apparatus 1 is not limited to this configuration, that is, the image recording apparatus 1 may be configured such that a plurality of the lock levers 220 are provided for the respective cartridges 10, a plurality of the opening and closing sensors 228 are respectively provided on the lock levers 220, and each of the plurality of the sensors 230, 235 provided for the corresponding one of the cartridges is controlled on the basis of a corresponding one of the plurality of the opening and closing sensors 228 in order to prevent the deterioration of each of the plurality of the sensors 230, 235. Further, a plurality of the lock levers 220 may be provided respectively for the plurality of the cartridges, and the cartridge mount 8 may have a double cover construction in which an outer cover for covering the lock levers 220 from an outer side thereof are provided. In this case, the opening and closing sensors 228 may be provided on the outer cover.

Further, in the explanation above, where the controller 200 confirms the presence of the cartridge 10 on the basis of the signal level, the presence of the cartridge 10 may be detected through only the second optical sensor 235 and may be detected through the second optical sensor 235 together with the first optical sensor 230.

Further, this image recording apparatus 1 includes two types of the optical sensors, i.e., the first optical sensor 230 and the second optical sensor 235, as the optical sensor, but may include one or, equal to or more than three type(s) of optical sensor(s). Even where the image recording apparatus 1 is thus constructed, the deterioration of the optical sensor(s) can be restrained by applying the present invention to the image recording apparatus 1 and by suitably changing the operational mode of the sensor(s) between the constant operational mode and the intermittent operational mode.

What is claimed is:

1. A cartridge-information detecting device comprising:

an optical sensor for detecting information about a cartridge which stores ink and is removably mounted on a cartridge mount, the information including specific information indicating that the cartridge is in a state of being mounted on or removed from the cartridge mount; and a controller including a timer which measures time and configured to execute a control for changing an operational mode of the optical sensor, wherein the controller permits the optical sensor to operate in a constant operational mode in which the information about the cartridge is constantly detected through the optical sensor until the timer has measured a predetermined time from a timing at which the detection of the information about the cartridge becomes to be allowed, and wherein the controller permits the optical sensor to operate in an intermittent operational mode in which only the specific information is intermittently detected through the optical sensor, after the predetermined time has passed.

2. The cartridge-information detecting device according to claim 1, wherein in a certain case, the controller permits the optical sensor operating in the intermittent operational mode to operate in the constant operational mode by changing the operational mode of the optical sensor from the intermittent operational mode to the constant operational mode.

3. The cartridge-information detecting device according to claim 2, wherein in a case where information that the cartridge is removed from the cartridge mount has been detected through the optical sensor operating in the intermittent operational mode, the controller permits the optical sensor to operate in the constant operational mode by changing the operational mode of the optical sensor from the intermittent operational mode to the constant operational mode.

4. The cartridge-information detecting device according to claim 2, wherein in a case where information that the cartridge is mounted on the cartridge mount has been detected through the optical sensor operating in the intermittent operational mode, the controller permits the optical sensor to operate in the constant operational mode by changing the operational mode of the optical sensor from the intermittent operational mode to the constant operational mode.

5. The cartridge-information detecting device according to claim 2, further comprising an information outputting portion configured to output information to a user on the basis of a command from the controller, wherein when information that the cartridge is mounted on the cartridge mount has been detected through the optical sensor operating in the intermittent operational mode, the controller controls the information outputting portion to output the information for prompting the user to remount the cartridge on the cartridge mount, and wherein in a case where information that the cartridge is removed from the cartridge mount has been detected through the optical sensor after the information outputting portion has outputted the information for prompting the user to remount the cartridge on the cartridge mount, the controller permits the optical sensor to operate in the constant operational mode by changing the operational mode of the optical sensor from the intermittent operational mode to the constant operational mode.

6. The cartridge-information detecting device according to claim 2, wherein when the controller permits the optical sensor to operate in the constant operational mode by changing the operational mode of the optical sensor from the intermittent operational mode to the constant operational mode, the controller resets the timer.

7. The cartridge-information detecting device according to claim 1, further comprising an information outputting portion configured to output information to a user on the basis of a command from the controller, wherein when information that the cartridge is mounted on the cartridge mount has been detected through the optical sensor operating in the intermittent operational mode, the controller controls the information outputting portion to output the information for prompting the user to remount the cartridge on the cartridge mount.

8. The cartridge-information detecting device according to claim 1, further comprising a mounting permission detecting sensor for detecting whether the mounting of the cartridge on the cartridge mount is permitted or inhibited, wherein the controller is further configured to judge whether the detection of the information about the cartridge is allowed or not, and wherein the controller judges that the detection of the information about the cartridge is allowed, on the basis of a signal from the mounting permission detecting sensor, which signal indicates that the mounting of the cartridge on the cartridge mount is permitted.

9. The cartridge-information detecting device according to claim 1, wherein the optical sensor includes (a) a first sensor for detecting the specific information, and (b) a second sensor for detecting another information about the cartridge in a mounting process in which the cartridge is being mounted on the cartridge mount.

10. The cartridge-information detecting device according to claim 9, wherein the controller permits both of the first sensor and the second sensor to operate in the constant operational mode until the timer has measured a specific time from a timing at which the specific information is detected through the first sensor, and wherein the controller permits at least the first sensor to operate in the intermittent operational mode after the specific time has passed.

11. The cartridge-information detecting device according to claim 10, wherein the controller permits only the first sensor to operate in the intermittent operational mode after the specific time has passed.

12. The cartridge-information detecting device according to claim 10, wherein the controller permits the first sensor to operate in the intermittent operational mode and permits the second sensor to be in a state in which the detection of the information about the cartridge is not allowed, after the specific time has passed.

* * * * *